US011622666B2

(12) United States Patent
Woo et al.

(10) Patent No.: US 11,622,666 B2
(45) Date of Patent: Apr. 11, 2023

(54) DISHWASHER

(71) Applicant: LG Electronics Inc., Seoul (KR)

(72) Inventors: Seyoung Woo, Seoul (KR); Joonho Pyo, Seoul (KR); Daegyu Kim, Seoul (KR); Taehee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 86 days.

(21) Appl. No.: 17/375,713

(22) Filed: Jul. 14, 2021

(65) Prior Publication Data

US 2021/0338037 A1 Nov. 4, 2021

Related U.S. Application Data

(60) Continuation of application No. 16/536,423, filed on Aug. 9, 2019, now Pat. No. 11,096,548, which is a division of application No. 15/654,388, filed on Jul. 19, 2017, now Pat. No. 10,617,278, which is a division of application No. 15/015,243, filed on Feb. 4, 2016, now Pat. No. 10,413,151.

(30) Foreign Application Priority Data

Feb. 4, 2015 (KR) ..... 10-2015-0017247
Feb. 4, 2015 (KR) ..... 10-2015-0017249

(51) Int. Cl.

| | |
|---|---|
| ***A47L 15/20*** | (2006.01) |
| ***A47L 15/22*** | (2006.01) |
| ***A47L 15/42*** | (2006.01) |
| ***A47L 15/23*** | (2006.01) |

(52) U.S. Cl.

CPC ..... *A47L 15/20* (2013.01); *A47L 15/22* (2013.01); *A47L 15/23* (2013.01); *A47L 15/4282* (2013.01)

(58) Field of Classification Search

CPC ..... A47L 15/20; A47L 15/22; A47L 15/23
See application file for complete search history.

(56) References Cited

U.S. PATENT DOCUMENTS

| | | |
|---|---|---|
| 3,876,148 A | 4/1975 | Cushing et al. |
| 5,415,350 A | 5/1995 | Yoon et al. |

FOREIGN PATENT DOCUMENTS

| | | |
|---|---|---|
| CN | 101095608 | 1/2008 |
| CN | 203789884 | 8/2014 |

(Continued)

OTHER PUBLICATIONS

CN Office Action in Chinese Appln. No. 201610065644.8, dated Feb. 5, 2018, 10 pages (with English translation).

(Continued)

*Primary Examiner* — Spencer E. Bell
(74) *Attorney, Agent, or Firm* — Fish & Richardson P.C.

(57) ABSTRACT

A dishwasher may include a sump configured to store water, a main arm disposed at the sump and configured to supply water from the sump, an auxiliary arm rotatably disposed at the main arm and configured to spray water, and an auxiliary arm connection member disposed at the main arm and configured to rotatably support the auxiliary arm, where the auxiliary arm may include an auxiliary flow passage configured to allow water flow through the auxiliary arm, where the main arm may include a transfer flow passage in fluid communication with the auxiliary flow passage, where the auxiliary arm connection member may include a flow tube disposed at the main arm in fluid communication with the transfer flow passage and the auxiliary flow passage.

20 Claims, 20 Drawing Sheets

(56) References Cited

FOREIGN PATENT DOCUMENTS

| | | |
|---|---|---|
| CN | 104706293 | 6/2015 |
| CN | 104739346 | 7/2015 |
| CN | 105832268 | 7/2018 |
| DE | 102007027930 | 2/2008 |
| JP | H07000336 | 1/1995 |
| JP | 3437241 | 6/2003 |
| JP | 2006192251 | 7/2006 |
| JP | 4191178 | 12/2008 |
| KR | 2019890008078 | 11/1989 |
| KR | 1020120134370 | 12/2012 |
| KR | 101269740 | 5/2013 |

OTHER PUBLICATIONS

CN Office Action in Chinese Appln. No. 201710152844.1, dated May 29, 2019, 10 pages (with English translation).
CN Office Action in Chinese Appln. No. 201710152844.1, dated Nov. 27, 2019, 9 pages (with English translation).
EP Extended European Search Report in European Appln. No. 17165771.1, dated Jun. 14, 2017, 7 pages (with English translation).
EP Extended European Search Report in European Appln. No. 16153613.1 dated May 11, 2016, 7 pages.
PCT International Search Report and Written Opinion in International Appln. No. PCT/KR2016/001188, dated May 12, 2016, 10 pages (with English translation).

DISHWASHER

CROSS-REFERENCE TO RELATED APPLICATIONS

The present application is a continuation of U.S. patent application Ser. No. 16/536,423, filed on Aug. 9, 2019, which is a division of U.S. patent application Ser. No. 15/654,388, filed on Jul. 19, 2017, now U.S. Pat. No. 10,617,278, which is division of U.S. patent application Ser. No. 15/015,243, filed on Feb. 4, 2016, now U.S. Pat. No. 10,413,151, which claims priority under 35 U.S.C. 119 and 35 U.S.C. 365 to Korean Patent Application No. 10-2015-0017247, filed on Feb. 4, 2015 and No. 10-2015-0017249, filed on Feb. 4, 2015. The disclosures of the prior applications are incorporated by reference in their entirety.

BACKGROUND

A dishwasher is a household appliance which uses detergent and water to wash food scraps off dirty dishes and cooking utensils.

Generally, a dishwasher includes a tub, a dish rack disposed in the tub to accommodate objects to be washed, a spray arm to spray wash water to the dish rack, a sump to store the wash water, and a supply flow passage to supply the wash water stored in the sump to the spray arm.

SUMMARY

According to one aspect, a dishwasher may include a sump configured to store water, a main arm disposed at the sump and configured to supply water from the sump, an auxiliary arm rotatably disposed at the main arm and configured to spray water, and an auxiliary arm connection member disposed at the main arm and configured to rotatably support the auxiliary arm, where the auxiliary arm may include an auxiliary flow passage configured to allow water flow through the auxiliary arm, where the main arm may include a transfer flow passage in fluid communication with the auxiliary flow passage, where the auxiliary arm connection member may include a flow tube disposed at the main arm in fluid communication with the transfer flow passage and the auxiliary flow passage, a shaft inserted into the auxiliary flow passage, a protrusion extending from the shaft, and one or more support ribs configured to connect the flow tube to the shaft, and a departure restriction part disposed at the auxiliary arm and configured to contact the protrusion, and to surround at least a portion of the shaft, thereby restricting separation from the auxiliary arm connection member based on rotation of the auxiliary arm.

Implementations according to this aspect may include one or more of the following features. For example, water flowing through the transfer flow passage may be introduced into the auxiliary flow passage via the flow tube. At least one of the one or more support ribs may include a flow hole defined at one side, where water flowing through the transfer flow passage flows to the auxiliary flow passage via the flow hole. The dishwasher may include a reinforcement rib disposed at the shaft. The reinforcement rib may be connected to at least one of the one or more support ribs. The one or more support ribs may include a plurality of support ribs, where the plurality of support ribs are positioned equiangular from each other with respect to the shaft. The departure restriction part may be configured to surround at least a portion of the shaft. The dishwasher may include a support part configured to support the shaft and disposed at the auxiliary flow passage, where the support part may be configured to surround at least a portion of the shaft. The auxiliary arm connection member may be configured to release from coupling with the auxiliary arm based on the auxiliary arm rotating to a position that defines a predetermined angle with the auxiliary arm connection member. The dishwasher may include a limiting part disposed at an outer circumferential surface of the flow tube and configured to limit an insertion range of the flow tube. The dishwasher may include a bearing disposed at the outer circumferential surface of the flow tube, and a contact part disposed at the auxiliary arm and configured to contact the bearing unit. The contact part may include a discharge hole configured to communicate with an outer portion of the auxiliary arm, where the discharge hole may be configured to discharge water flowed backward from the auxiliary flow passage to the contact part. The flow tube may be integral with the main arm. The one or more support ribs may include a first support rib disposed at a first side of the flow tube and configured to extend in a longitudinal direction of the flow tube, a second support rib disposed at a second side of the flow tube and parallel to the first support rib, and a third support rib connected to the first support rib and the second support rib, where the shaft may be connected to the third support rib. Each of a connection part configured to connect the first support rib to the third support rib, and a connection part configured to connect the second support rib to the third support rib may be rounded. An inner circumferential surface of the third support rib may be oriented an acute angle with the longitudinal direction of the flow tube. The inner circumferential surface of the third support rib may be inclined and configured to guide upward water introduced into the auxiliary flow passage via the flow tube.

Front end portions of the one or more support ribs may be connected to the shaft, where rear end portions of the one or more support ribs are connected to the inner circumferential surface of the flow tube. The rear end portions of the one or more support ribs may be inclined at acute angles with the inner circumferential surface of the flow tube. A vertical width of the one or more support ribs may be greater than a horizontal width. The rear end portions of the one or more support ribs may be configured to extend downward from an upper portion of the inner circumferential surface of the flow tube. The rear end portions of the one or more support ribs may be configured to extend upward from a lower portion of the inner circumferential surface of the flow tube.

According to another aspect, a dishwasher may include a sump configured to store water, a main arm disposed at the sump and configured to receive the water from the sump, an auxiliary arm rotatably disposed at the main arm and including an auxiliary spray hole configured to spray the water, an auxiliary flow passage formed in the auxiliary arm and configured to supply the water discharged through the auxiliary spray hole, a transfer flow passage formed in the main arm and configured to supply the water to the auxiliary flow passage, and an auxiliary arm connection member connected to the main arm and inserted into the auxiliary flow passage to rotatably support the auxiliary arm, where a departure restriction part may be disposed at the auxiliary arm and is configured to contact one side of the auxiliary arm connection member and to restrict separation from the auxiliary arm connection member based on rotation of the auxiliary arm, where a flow hole through which the water flows is formed at the auxiliary arm connection member, and where the water flowing through the transfer flow passage is introduced into the auxiliary flow passage via the flow hole.

Implementations according to this aspect may include one or more of the following features. For example the auxiliary arm connection member may include a flow tube disposed at the main arm and configured to communicate with the transfer flow passage and the auxiliary flow passage a shaft inserted into the auxiliary flow passage, a protrusion configured to extend from the shaft, and at least one or more support ribs configured to connect the flow tube to the shaft.

DETAILED DESCRIPTION

Figure 1:
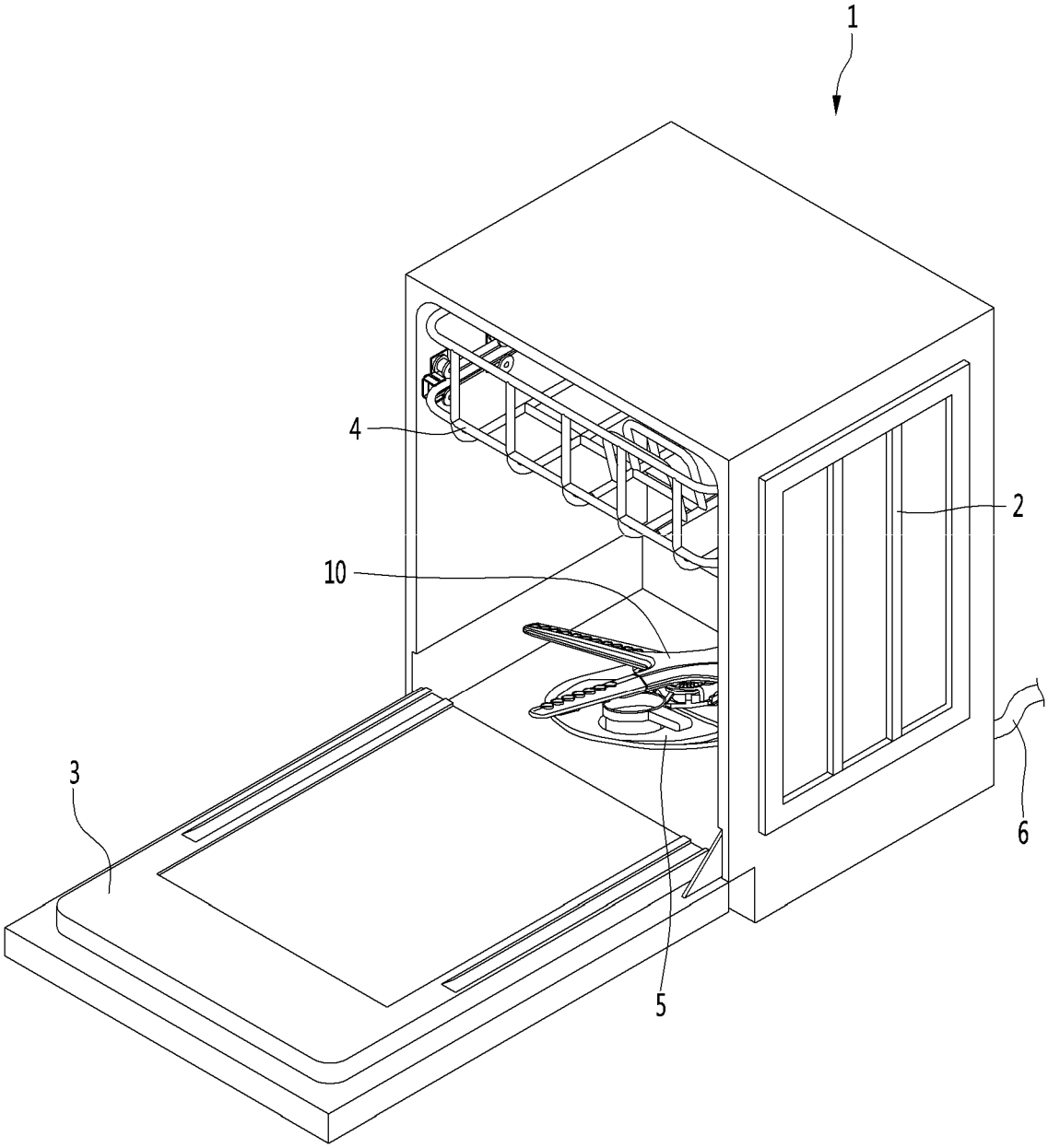
FIG. 1 is a perspective view of an example of a dishwasher.
Figure 2:
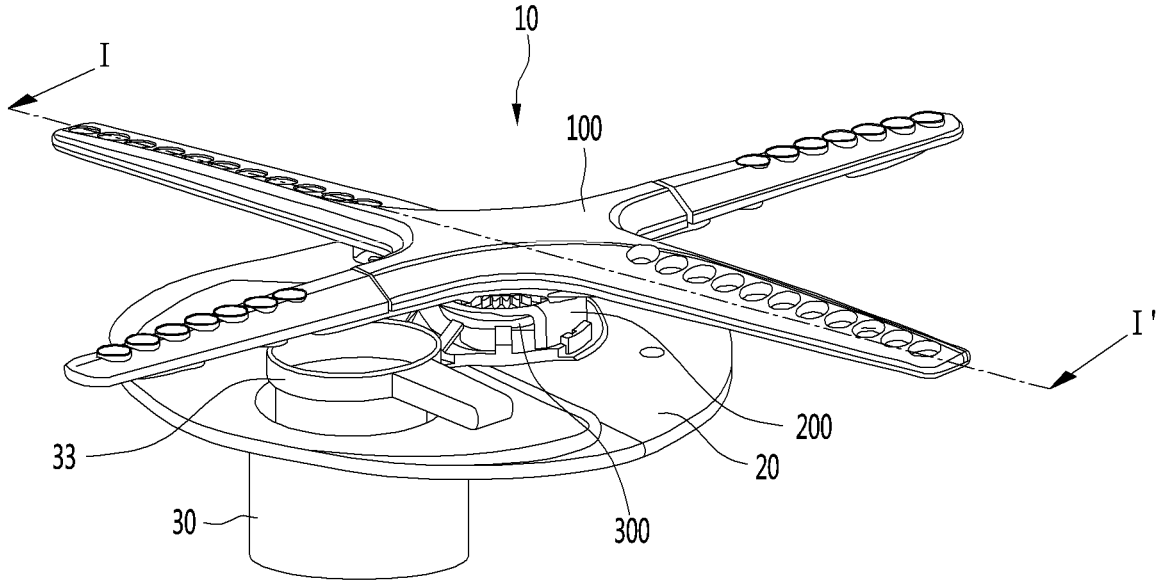
FIG. 2 is a view illustrating an example of a coupling structure between a sump of FIG. 1 and a spray arm assembly.

Referring to FIGS. 1 and 2, a dishwasher 1 may include a tub 2 in which a washing space is formed, a door 3 which may be configured to selectively open and close the washing space, a rack 4 disposed in the tub 2 to accommodate an object to be washed, a sump 5 disposed in the tub 2 to store wash water, and a spray arm assembly 10 disposed in the tub 2 to spray the wash water onto the object to be washed accommodated in the rack 4.

The rack 4 may be mounted to be withdrawn to the front of the tub 2. A user may withdraw the rack 4 to the front of the tub 2 to accommodate the object to be washed.

The sump 5 may include a sump cover 20 and a sump discharge unit 30 disposed at the sump cover 20. The sump 5 may receive the wash water from the outside through a water supply unit 6, and may discharge the wash water sprayed in the tub 2 through the sump discharge unit 30. A water supply pump to transfer the wash water stored in the sump 5 to the spray arm assembly 10 may be disposed in the sump 5.

A wash water recovery unit 33 to recover the wash water sprayed in the tub 2 may be disposed at the sump discharge unit 30. Foreign substances such as food scraps contained in the wash water may be filtered by a filter disposed in the wash water recovery unit 33. The wash water recovered in the sump 5 through the wash water recovery unit 33 may be resupplied to the spray arm assembly 10 by the water supply pump disposed in the sump 5. The wash water supplied through the water supply unit 6 may be reused several times.

The spray arm assembly 10 may be mounted on the sump cover 20 to spray the wash water stored in the sump 5 onto the object to be washed accommodated in the rack. The spray arm assembly 10 may include a spray arm 100 to spray the wash water, a fixed gear unit 200 mounted on the sump cover 20 to rotatably support the spray arm 100, and an arm holder 300.

The wash water introduced through the water supply unit 6 may flow through the sump 5 to be introduced into the spray arm assembly 10, and the wash water introduced into the spray arm assembly 10 may be sprayed by the spray arm 100 onto the object to be washed. The spray arm assembly 10 may be directly connected to the water supply unit 6 and directly spray the wash water onto the object to be washed without passing through the sump 5.

The spray arm assembly 10 may not only be disposed below the rack 4 as illustrated, but also be disposed above the rack 4. The spray arm assembly 10 may be disposed in a plurality to spray the wash water from above and below the rack 4.

Figure 3:
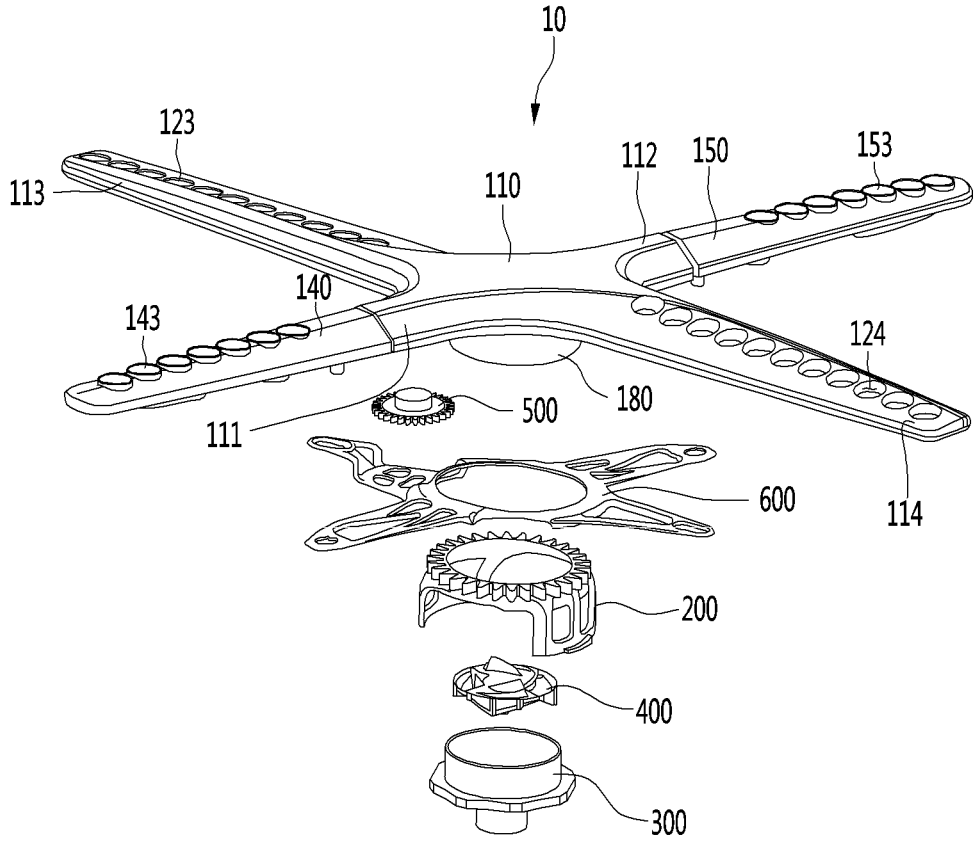
FIG. 3 is an exploded perspective view of an example of the spray arm assembly of FIG. 2.

As illustrated in FIG. 3, the spray arm assembly 10 may include the spray arm 100, the fixed gear unit 200, the arm holder 300, a flow passage switching unit 400, a rotary gear unit 500, and a link member 600.

The spray arm 100 may include a main arm 110 and auxiliary arms 140 and 150 rotatably connected to the main arm 110. The auxiliary arms 140 and 150 may be provided as one pair as illustrated. A plurality of flow passages through which the wash water provided from the sump 5 flows may be formed in the main arm 110.

Upper spray holes 123 and 124 through which the wash water introduced into the main arm 110 is sprayed may be formed in an upper portion of the main arm 110. The wash water introduced into the main arm 110 from the sump 5 may be sprayed above the main arm 110 through the upper spray holes 123 and 124. The wash water sprayed through the upper spray holes 123 and 124 may head toward the object to be washed.

The main arm 110 may include an arm holder coupling unit 180 disposed at a bottom surface of the main arm 110 and having at least a portion of the arm holder 300.

The auxiliary arms 140 and 150 may by be rotated by the link member 600 within a predetermined angle range. Upper auxiliary spray holes 143 and 153 may be configured to spray the wash water introduced into the main arm 110. Upper auxiliary spray holes may also be formed in the auxiliary arms 140 and 150.

The main arm 110 may include a first extension part 111 and a second extension part 112 radially extending with respect to the arm holder coupling unit 180. The auxiliary arms 140 and 150 respectively, may be and rotatably mounted on the first extension part 111 and the second extension part 112.

A first transfer flow passage and a second transfer flow passage, through which the wash water introduced from the sump 5 flows, may be respectively formed in the first extension part 111 and the second extension part 112. The wash water flowing through the first transfer flow passage and the second transfer flow passage may flow to the auxiliary arms 140 and 150.

The auxiliary arms 140 and 150 may include a first auxiliary arm 140 rotatably connected to the first extension part 111, and a second auxiliary arm 150 rotatably connected to the second extension part 112. Some of the wash water introduced into the main arm 110 may flow to a first auxiliary flow passage (141, refer to FIG. 14) formed in the first auxiliary arm 140 and a second auxiliary flow passage formed in the second auxiliary arm 150.

A first upper auxiliary spray hole 143 may be formed in the first auxiliary arm 140, and a second upper auxiliary spray hole 153 may be formed in the second auxiliary arm 150. The wash water introduced into the first auxiliary flow passage (141, refer to FIG. 14) formed in the first auxiliary arm 140 may be sprayed through the first upper auxiliary spray hole 143, and the wash water introduced into the second auxiliary flow passage formed in an inner space of the second auxiliary arm 150 may be sprayed through the second upper auxiliary spray hole 153.

The spray arm 100 may be rotated by a repulsive force generated when the wash water is sprayed through upper spray holes 123 and 124 or the upper auxiliary spray holes 143 and 153. That is, the spray arm 100 may be rotated by the repulsive force generated by spraying the wash water without a separate driving device such as a motor.

The main arm 110 may include a first arm 113 extending along one direction from a center of the main arm 110, and a second arm 114 extending along the opposite direction of the first arm 113. A first upper spray hole 123 may be formed in the first arm 113, and a second upper spray hole 124 may be formed in the second arm 114.

The first upper spray hole 123 may be formed in a plurality along a longitudinal direction of the first arm 113. The second upper spray hole 124 may be formed in a plurality along a longitudinal direction of the second arm 114.

The spray arm 100 may be rotated in one direction by a repulsive force generated when the wash water being sprayed through the first upper spray hole 123 and the second upper spray hole 124. A plurality of repulsive forces may be generated since the wash water is sprayed through the plurality of spray holes. The first upper spray hole 123 and the second upper spray hole 124 are disposed such that a resultant force of the plurality of repulsive forces generated by the spraying of the wash water rotates the spray arm 100 in one direction.

The wash water introduced into the spray arm 100 may flow to the main arm 110 and be sprayed through the upper spray holes 123 and 124. Also, the wash water introduced into the spray arm 100 may flow to the auxiliary arms 140 and 150 and be sprayed through the upper auxiliary spray holes 143 and 153.

The fixed gear unit 200 may be fixed to the sump cover 20 by a gear fixing unit 22 disposed at the sump cover 20. The fixed gear unit 200 may be disposed to be engaged with the rotary gear unit 500.

The arm holder 300 may be coupled to the spray arm 100 and be fixed to the spray arm 100. The arm holder 300 may rotate together with the spray arm 100, and may serve as a central axis of rotation of the spray arm 100.

The arm holder 300 may be rotatably fixed to the sump cover 20 while being coupled to the spray arm 100. The wash water supplied from the sump 5 may be supplied to the spray arm 100 after being introduced into the arm holder 300.

The arm holder 300 may be integrally formed with the main arm 110. In some examples, the main arm 110 is rotatably fixed to the sump cover 20.

The flow passage switching unit 400 may be accommodated in the arm holder 300 and serve to switch the flow passage of the wash water supplied to the spray arm 100 from the arm holder 300.

The rotary gear unit 500 may be rotatably mounted on a bottom surface of the spray arm 100. When the spray arm 100 rotates, the rotary gear unit 500 may simultaneously move circularly along a circumference of the fixed gear unit 200 fixed to the sump cover 20 and rotate by being engaged with the fixed gear unit 200.

The link member 600 may be mounted on the spray arm 100. The link member 600 may rotate the auxiliary arms 140 and 150 back and forth as the rotary gear unit 500 rotates.

Figure 4:
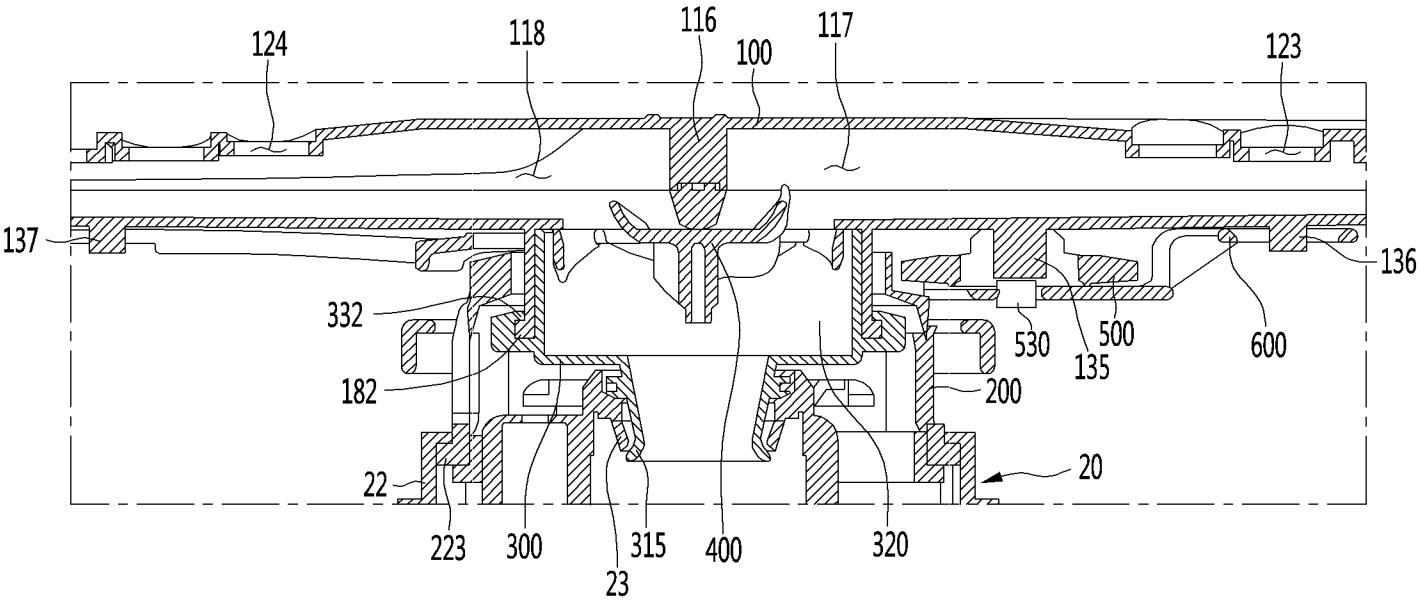
FIG. 4 is a cross-sectional view of the spray arm assembly of FIG. 2 taken along line I-I'.

Referring to FIG. 4, the spray arm assembly 10 may be fastened to the sump cover 20. The arm holder 300 may be rotatably fixed to the sump cover 20 as an extension part 315 formed at the arm holder 300 is fastened to an arm holder fastening part 23 disposed at the sump cover 20.

A fastening part 223 disposed at the fixed gear unit 200 may be fastened to the gear fixing unit 22 disposed at the sump cover 20. Accordingly, the fixed gear unit 200 may be coupled to the sump cover 20. In contrast to the arm holder 300, the fixed gear unit 200 is non-rotatably fixed.

The rotary gear unit 500 may inserted into a gear rotation shaft 135 disposed at the spray arm 100. Accordingly, the rotary gear unit 500 may be coupled to the spray arm 100 and may rotate about the gear rotation shaft 135.

The link member 600 may be supported by guide protrusions 136 and 137 disposed at the spray arm 100. An eccentric protrusion 530 disposed at the rotary gear unit 500 may be inserted into the link member 600. By the rotation of the fixed gear unit 200, the eccentric protrusion 530 may rotate the link member 600 back and forth within a predetermined range.

A fastening protrusion 182 disposed at the spray arm 100 may be inserted into a fastening protrusion accommodation unit 332 disposed at the arm holder 300. The arm holder 300 is coupled to the spray arm 100.

Main flow passages 117 and 118 through which the wash water introduced from the arm holder 300 flows may be formed in the spray arm 100. The main flow passages 117 and 118 include a first main flow passage 117 formed in the first arm 113, and a second main flow passage 118 formed in the second arm 114. The first main flow passage 117 and the second main flow passage 118 may be divided from each other by a partition 116. The wash water flowing through the first main flow passage 117 may be sprayed to the outside through the first upper spray hole 123, and the wash water flowing through the second main flow passage 118 may be sprayed to the outside through the second upper spray hole 124. The main flow passages 117 and 118 may be referred to as 'wash water flow passages.'

The flow passage switching unit 400 may be accommodated in an arm holder chamber 320 disposed in the arm holder 300. The flow passage switching unit 400 may move upward when the hydraulic pressure in the arm holder chamber 320 increases due to the wash water being introduced into the arm holder chamber 320, and the flow passage switching unit 400 may move downward when the hydraulic pressure in the arm holder chamber 320 decreases due to the introduction of the wash water into the arm holder chamber 320 being stopped. In addition, the wash water accommodated in the arm holder chamber 320 may be introduced into the main arm 110.

Figure 5:
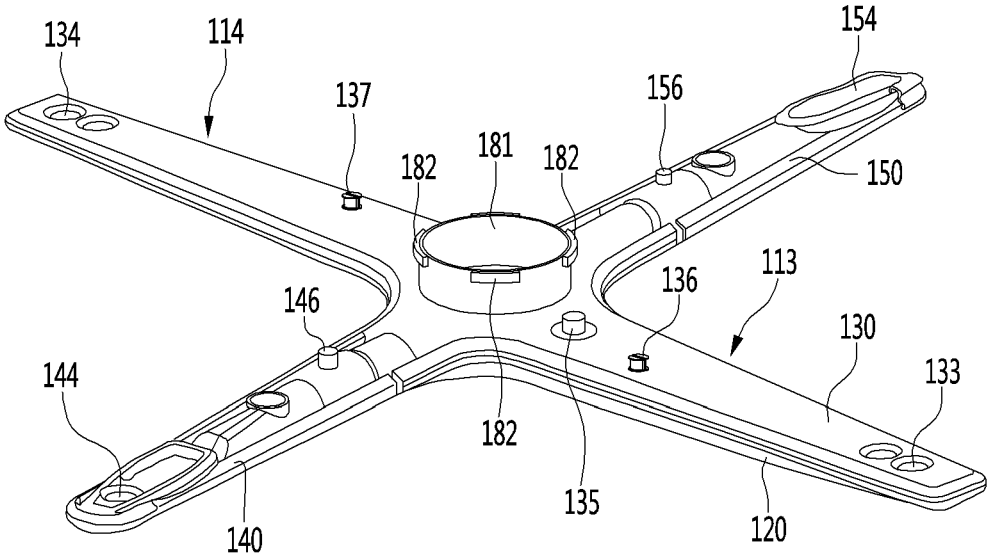
FIG. 5 is a view illustrating a bottom surface of the spray arm of FIG. 3.
Figure 6:
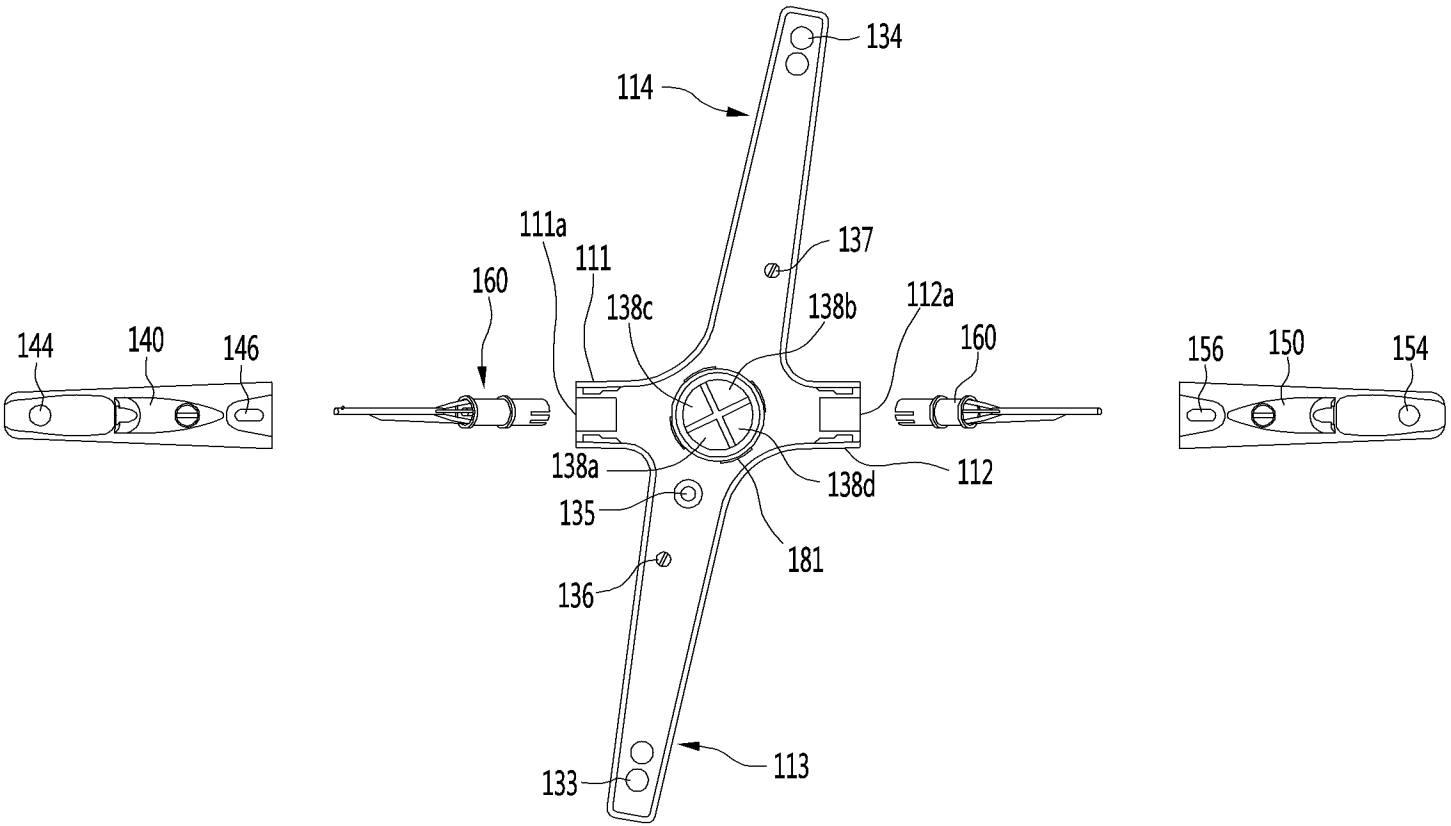
FIG. 6 is an exploded view of the spray arm of FIG. 5.

Referring to FIGS. 5 and 6, the spray arm 100 may include the main arm 110, the auxiliary arms 140 and 150, and auxiliary arm connection members 160 configured to connect the main arm 110 to the auxiliary arms 140 and 150. The main arm 110 may include an upper frame 120 and a lower frame 130.

Lower spray holes 133 and 134 through which the wash water introduced into the main arm 110 is sprayed may be formed in the lower frame 130. The wash water introduced into the main arm 110 may be sprayed below the main arm 110 through the lower spray holes 133 and 134. The upper spray holes 123 and 124 and the lower spray holes 133 and 134 may be collectively referred to as 'main spray holes.'

A repulsive force may be generated below the main arm 110 when the wash water is sprayed upward from the upper spray holes 123 and 124, and the repulsive force may be generated above the main arm 110 when the wash water is sprayed downward from the lower spray holes 133 and 134. The wash water introduced into the main arm 110 may be simultaneously sprayed through the upper spray holes 123 and 124 and the lower spray holes 133 and 134, thereby offsetting the repulsive forces in the upper and lower directions acting on the main arm 110 due to the spraying of the wash water.

The main arm 110 may include a first outlet 111*a* formed at the first extension part 111, and a second outlet 112*b* formed at the second extension part 112. A portion of the wash water introduced into the main arm 110 through the sump 5 may be introduced into the first auxiliary arm 140 through the first outlet 111*a*, and a portion may be introduced into the second auxiliary arm 150 through the second outlet 112*b*.

As illustrated, the first auxiliary arm 140 may be disposed to form an acute angle with the first arm 113, and the second auxiliary arm 150 may be disposed to form an acute angle with the second arm 114. However, implementations are not limited to this shape, and the shape may be appropriately changed according to a design. For example, the first arm 113 and the second arm 114 may be disposed to form an acute angle, and the first auxiliary arm 140 an the second auxiliary arm 150 may be disposed to form an acute angle.

Lower auxiliary spray holes 144 and 154 may be formed in bottom surfaces of the auxiliary arms 140 and 150. A first lower auxiliary spray hole 144 may be formed in the first auxiliary arm 140, and a second lower auxiliary spray hole 154 may be formed in the second auxiliary arm 150.

The wash water introduced into the auxiliary arms 140 and 150 may be sprayed simultaneously through the upper auxiliary spray holes 143 and 153 and the lower auxiliary spray holes 144 and 154, thereby offsetting the repulsive forces in the upper and lower directions acting on the auxiliary arms 140 and 150 due to the spraying of the wash water.

The upper auxiliary spray holes 143 and 153 and the lower auxiliary spray holes 144 and 154 may be collectively referred to as 'auxiliary spray holes.'

The main arm 110 may include the gear rotation shaft 135 inserted into the rotary gear unit 500 to serve as a rotation shaft of the rotary gear unit 500. The gear rotation shaft 135 may protrude from the lower frame 130. The gear rotation shaft 135 may be disposed at the bottom surface of the first arm 113 as illustrated, but the implementations are not limited thereto.

The spray arm 100 may include the guide protrusions 136 and 137 to guide a movement of the link member 600. The guide protrusions 136 and 137 may include a first guide protrusion 136 disposed at the bottom surface of the first arm 113, and a second guide protrusion 137 disposed at the bottom surface of the second arm 114. The first guide protrusion 136, the gear rotation shaft 135, and the second guide protrusion 137 may be placed on one straight line.

The auxiliary arms 140 and 150 may include power transfer units 146 and 156 to receive power from the link member 600. The power transfer units 146 and 156 may be formed of protrusions that extend downward from the bottom surfaces of the auxiliary arms 140 and 150. The link member 600 may be configured to transfer the power received from the rotary gear unit 500 to the power transfer units 146 and 156, thereby enabling the auxiliary arms 140 and 150 to rotate back and forth. A first power transfer unit 146 may be disposed at the first auxiliary arm 140, and a second power transfer unit 156 may be disposed at the second auxiliary arm 150.

The main arm 110 may include the arm holder coupling unit 180 disposed at the lower frame 130. The arm holder coupling unit 180 may include an arm holder accommodation tube 181 into which the arm holder 300 is inserted, and the fastening protrusion 182 fastened to the arm holder 300. The fastening protrusion 182 may be fastened to the arm holder 300 enabling the main arm 110 to be fixed to the arm holder 300.

The arm holder accommodation tube 181 may extend downward from the lower frame 130. The arm holder accommodation tube 181 may be formed in a cylindrical shape and may contact the arm holder 300.

The fastening protrusion 182 may be fastened to the arm holder 300 enabling the main arm 110 to be fixed to the arm holder 300. The fastening protrusion 182 may be disposed in a plurality along an outer circumferential surface of the arm holder coupling unit 180.

The main arm 110 may include a plurality of inlets 138*a*, 138*b*, 138*c*, and 138*d* through which the wash water supplied from the arm holder 300 is introduced. The plurality of inlets 138*a*, 138*b*, 138*c*, and 138*d* may be disposed at the lower frame 130.

The plurality of inlets 138*a*, 138*b*, 138*c*, and 138*d* include a first inlet 138*a* configured to communicate with the first main flow passage 117, and a second inlet 138*b* communicating with the second main flow passage 118. The wash water introduced through the first inlet 138*a* may flow to the first main flow passage 117 to be sprayed through the spray holes 123 and 133 disposed in the first arm 113, and the wash water introduced through the second inlet 138*b* may flow to the second main flow passage 118 to be sprayed through the spray holes 124 and 134 disposed in the second arm 114.

The plurality of inlets 138*a*, 138*b*, 138*c*, and 138*d* may include a third inlet 138*c* communicating with the first outlet 111*a*, and a fourth inlet 138*d* communicating with the second outlet 112*b*.

The first transfer flow passage may be formed by the communication between the first outlet 111*a* and the third inlet 138*c*, and the second transfer flow passage may be formed by the communication between the second outlet 112*b* and the fourth inlet 138*d*. The first transfer flow passage and the second transfer flow passage may be divided from each other by the partition 116.

The wash water introduced through the third inlet 138*c* may flow to the first auxiliary arm 140 via the first transfer flow passage to be sprayed through the spray holes 143 and 144 disposed in the first auxiliary arm 140, and the wash water introduced through the fourth inlet 138*d* may flow to the second auxiliary arm 150 via the second transfer flow passage to be sprayed through the spray holes 153 and 154 disposed in the second auxiliary arm 150.

The flow passage switching unit 400 may open or close the plurality of inlets 138*a*, 138*b*, 138*c*, and 138*d* while ascending and descending in the arm holder 300.

The auxiliary arm connection member 160 may be inserted into the auxiliary arms 140 and 150 to rotatably support the auxiliary arms 140 and 150.

The spray arm 100 may not include the auxiliary arm connection member 160. In some examples the auxiliary arms 140 and 150 may be directly rotatably connected to the main arm 110.

Figure 7:
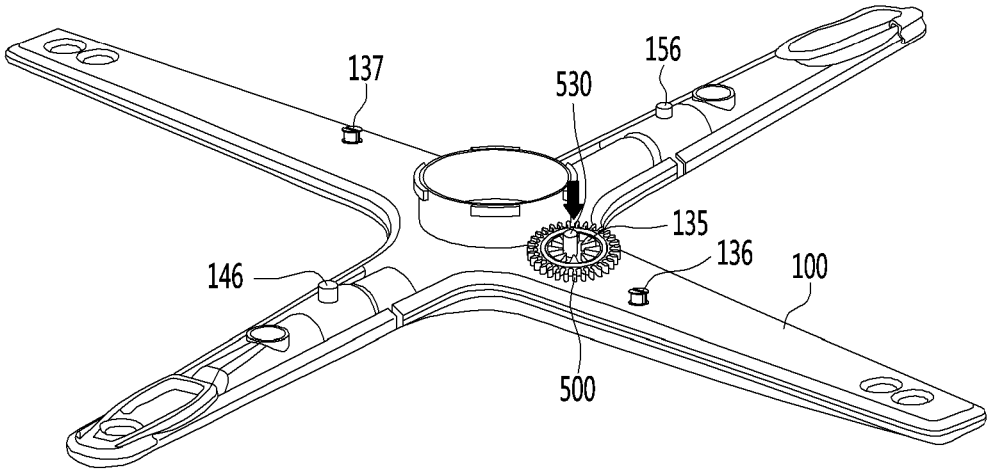
FIGS. 7 to 10 are views for describing an order of assembling the spray arm assembly of FIG. 3.

Referring to FIGS. 7 to 10, the spray arm 100 is first coupled to rotary gear unit 500 (refer to FIG. 7). The rotary gear unit 500 may be inserted into the gear rotation shaft 135 disposed at the spray arm 100.

Figure 8:
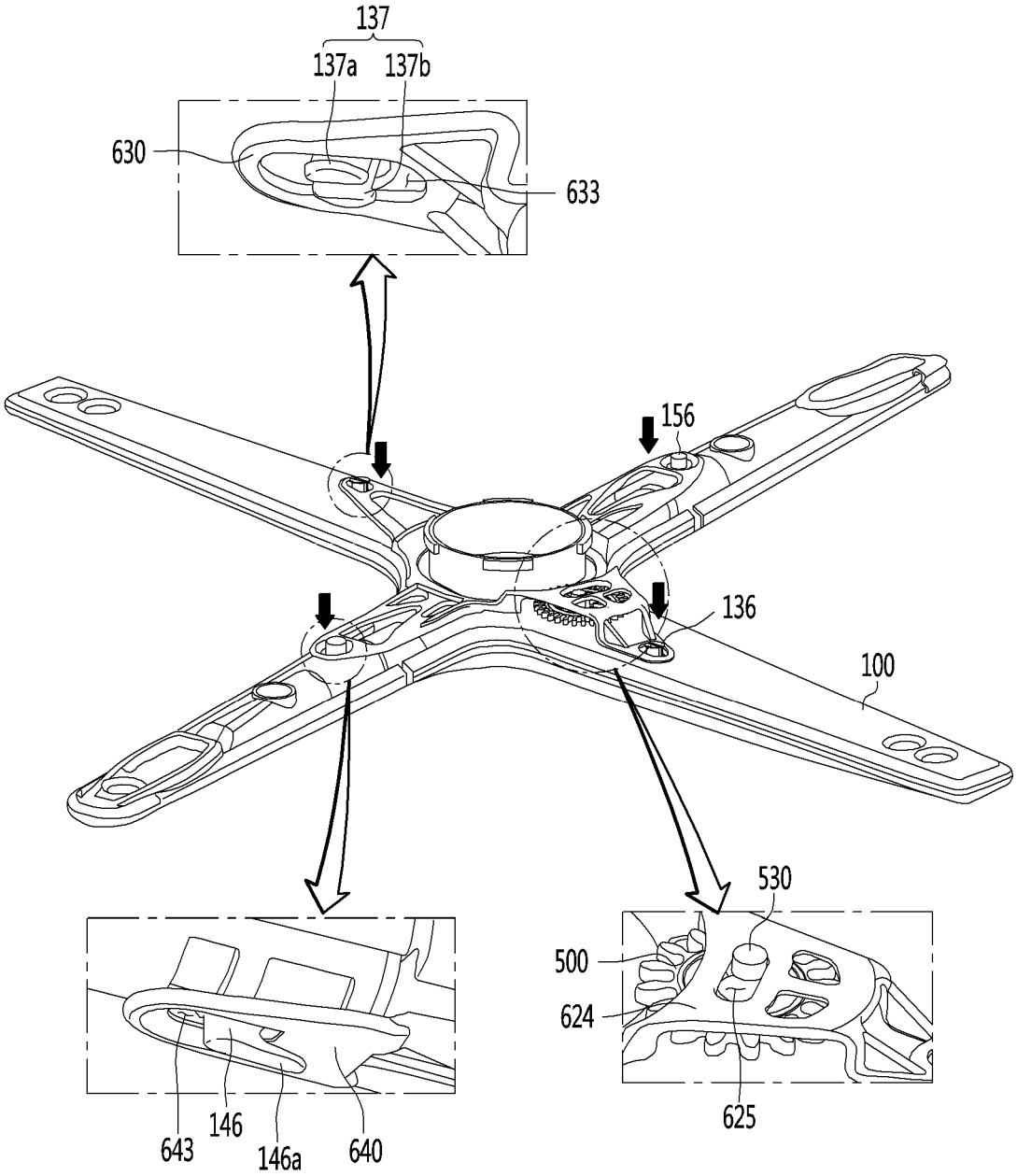

Next, the link member 600 may be additionally mounted on the spray arm 100 (refer to FIG. 8). The link member 600 is first connected to the power transfer units 146 and 156 and then connected by the guide protrusions 136 and 137. That is, the link member 600 may be connected to four points of the spray arm 100. Here, the eccentric protrusion 530 of the rotary gear unit 500 is inserted into an insertion part 625 disposed in the link member 600.

The first power transfer unit 146 may be inserted into a first locking part 643 disposed at the link member 600. The first power transfer unit 146 may include a departure prevention rib 146*a* to prevent the power transfer unit 146 from departing from the first locking part 643. The departure prevention rib 146*a* may extend toward the center of the spray arm 100 as illustrated. Likewise, the second power transfer unit 156 may include a departure prevention rib with the same shape as the departure prevention rib 146*a* disposed in the first power transfer unit 146.

The second guide protrusion 137 may be inserted into the second guide part 633. The second guide protrusion 137 may be formed of two elastic bodies 137*a* and 137*b* as illustrated. End portions of the two elastic bodies 137*a* and 137*b* may extend along a horizontal direction to prevent the second guide protrusion 137 from departing from the second guide part 633. When the second guide protrusion 137 is inserted into the second guide part 633, the two elastic bodies 137*a* and 137*b* may be bent in directions approaching each other. After the second guide protrusion 137 is inserted into the second guide part 633, the two elastic bodies 137*a* and 137*b* are restored to original states due to elasticity. The first guide protrusion 136 may be formed with the same shape as the second guide protrusion 137.

Figure 9:
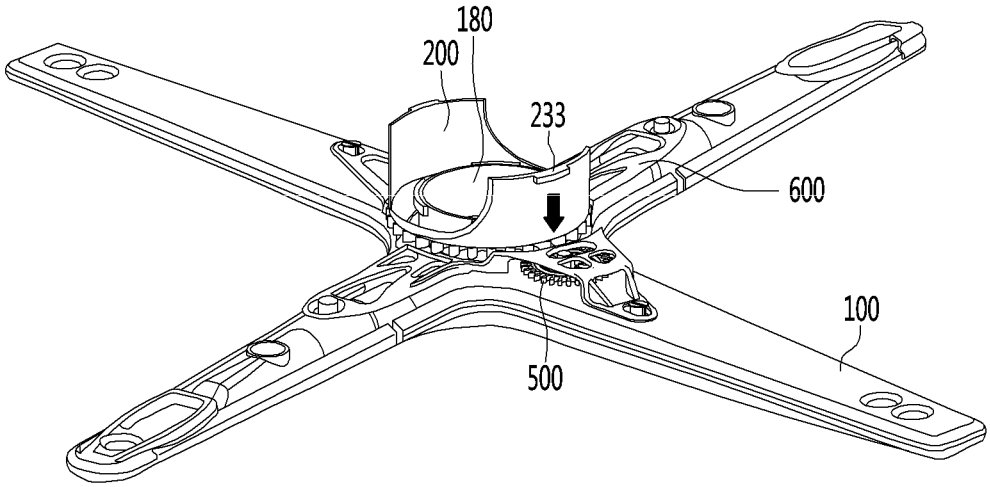

Next, the fixed gear unit 200 is additionally coupled to the spray arm 100 (refer to FIG. 9). The fixed gear unit 200 is mounted so as to surround the circumference of the arm holder coupling unit 180. That is, the arm holder coupling unit 180 is inserted into an opened portion of the fixed gear unit 200. Here, the gear teeth of the fixed gear unit 200 are engaged with the gear teeth of the rotary gear unit 500.

Figure 10:
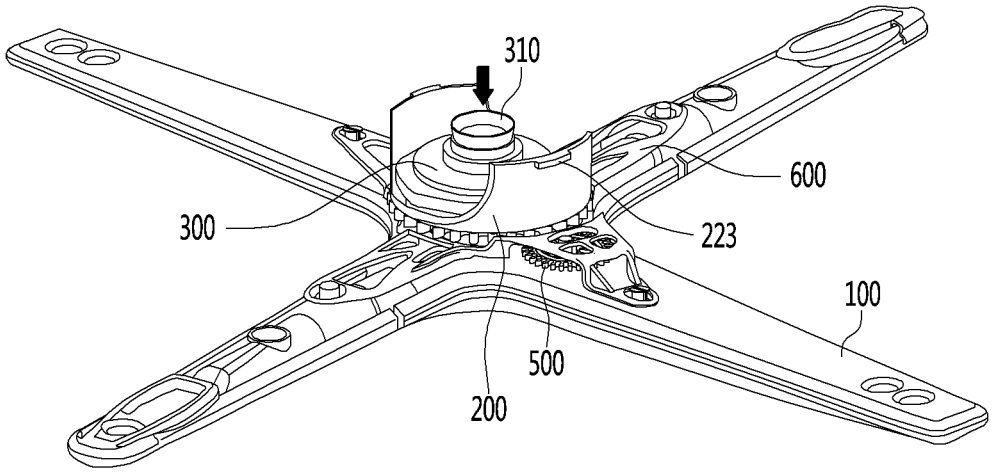
Figure 11A:
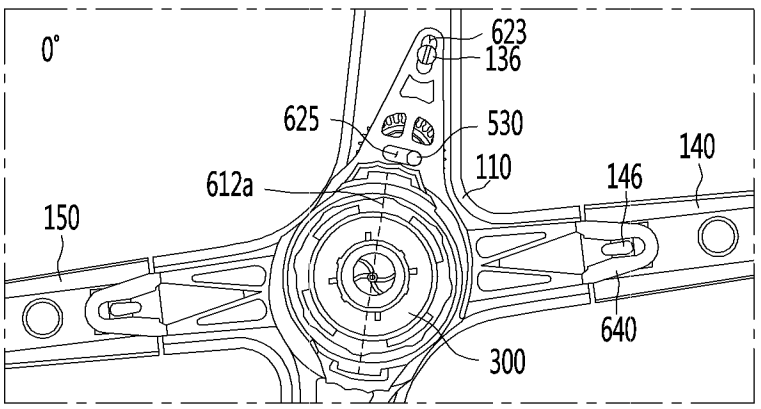
FIG. 11 (*a*) to FIG. 11 (*d*) are views illustrating an example of a bottom surface of a spray arm assembly in accordance with a rotational angle of a rotary gear unit.
Figure 11B:
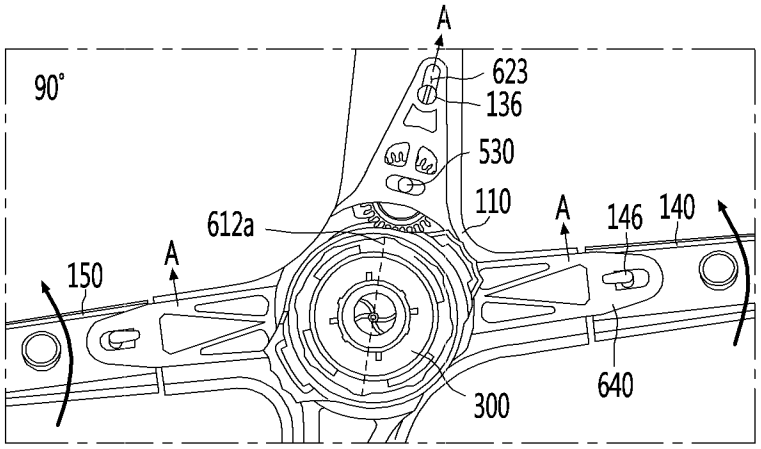
Figure 11C:
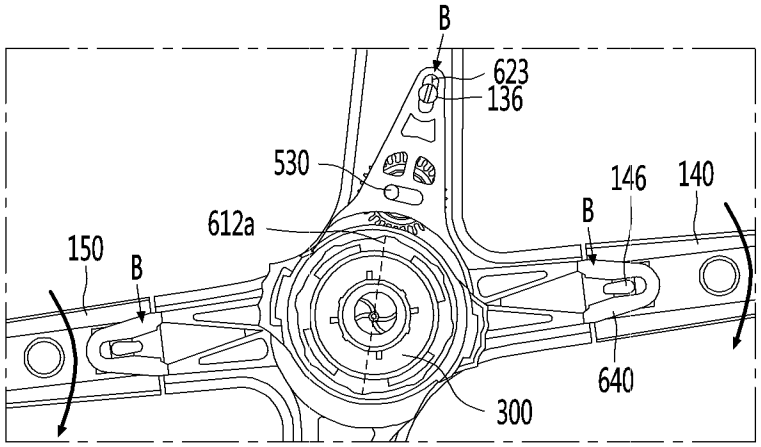
Figure 11D:
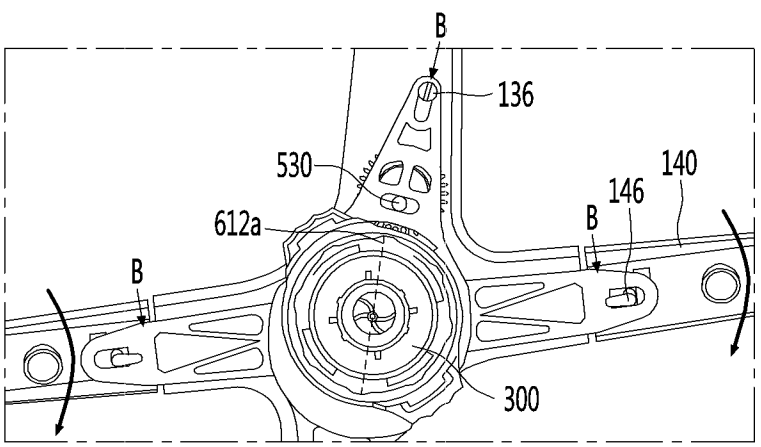
Figure 12A:
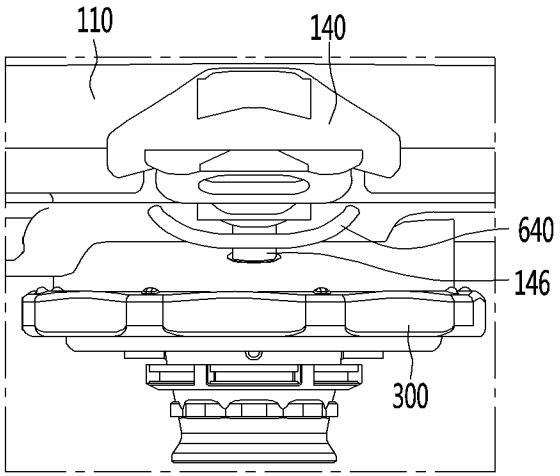
FIG. 12 (*a*) to FIG. 12 (*d*) are side views of the spray arm assembly of FIG. 11.
Figure 12B:
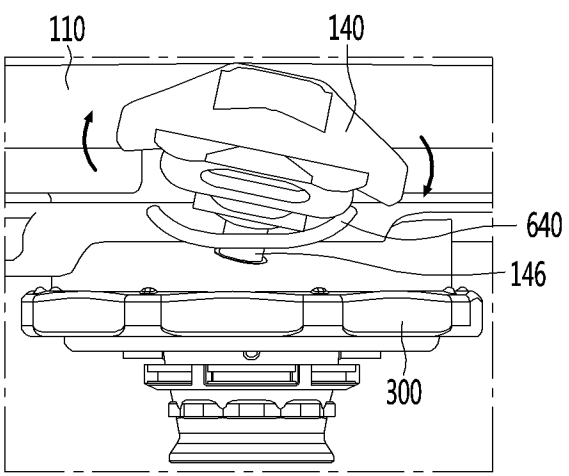
Figure 12C:
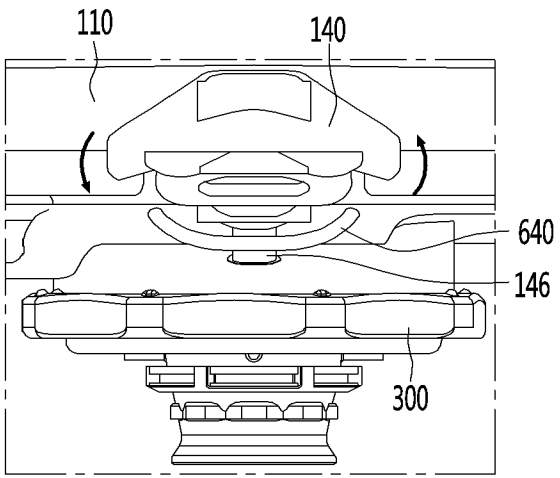
Figure 12D:
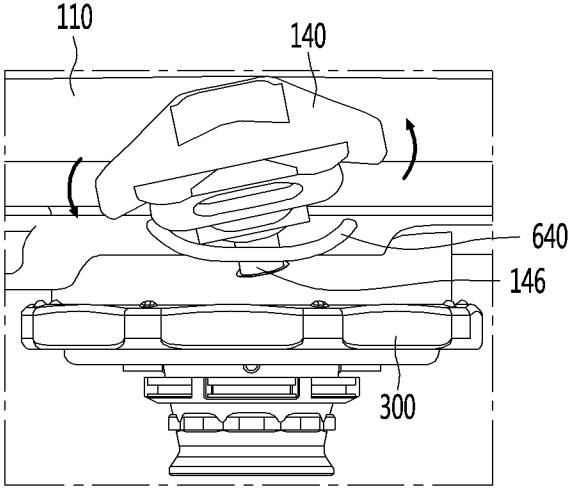

Next, the arm holder 300 is additionally coupled to the spray arm 100 (refer to FIG. 10). First, after the arm holder 300 is inserted into the arm holder coupling unit 180, the fastening protrusion 182 is accommodated in the fastening protrusion accommodation unit 332 when the arm holder 300 is rotated by a predetermined angle. Accordingly, the arm holder 300 may be coupled to the arm holder coupling unit 180.

Next, the fixed gear unit 200 is fixed to the sump cover 20 as the fastening part 223 is fastened to the sump cover 20. Simultaneously, the arm holder 300 may be inserted into the sump 5.

Referring to FIGS. 11(*a*) and 12(*a*), when the rotary gear unit 500 is in an initial unrotated state, the eccentric protrusion 530 is located at one side in the insertion part 625. The first auxiliary arm 140 may be disposed parallel to the main arm 110.

Referring to FIGS. 11(*b*) and 12(*b*), when the rotary gear unit 500 has rotated counterclockwise by 90°, the link member 600 is configured to move along a direction A among directions of a longitudinal axis 612*a* by the eccentric protrusion 530.

A first auxiliary extension part 640 applies a force to the first power transfer unit 146 due to the link member 600 moving along a direction of the longitudinal axis 612*a*. Accordingly, the first auxiliary arm 140 is rotated clockwise by a predetermined angle. A rotational angle of the first auxiliary arm 140 is approximately 20°.

Referring to FIGS. 11(*c*) and 12(*c*), when the rotary gear unit 500 has further rotated counterclockwise by 90°, the link member 600 is configured to move along a direction B which is opposite from the direction A of the longitudinal axis 612*a*. Accordingly, the link member 600 is restored to the position illustrated in FIGS. 11(*a*) and 12(*a*). Simultaneously, the first auxiliary arm 140 is restored to an original position after rotating counterclockwise by the first auxiliary extension part 640.

Referring to FIGS. 11(*d*) and 12(*d*), when the rotary gear unit 500 has further rotated counterclockwise by 90°, the link member 600 is configured to move along the direction B among the directions of the longitudinal axis 612*a* by the eccentric protrusion 530. Here, the first auxiliary arm 140 is rotated counterclockwise by a predetermined angle. The rotational angle of the first auxiliary arm 140 is approximately 20°.

Meanwhile, the second auxiliary arm 150 may simultaneously rotate by the same angle as the first auxiliary arm 140 due to the link member 600. However, when viewed from the side, the second auxiliary arm 150 rotates along a direction opposite from the first auxiliary arm 140.

Thus, the link member 600 may move back and forth within a distance between a top dead point and a bottom dead point of the eccentric protrusion 530 due to the rotation of the rotary gear unit 500.

Since the fixed gear unit 200, the rotary gear unit 500, and the link member 600 interact with each other to rotate the auxiliary arms 140 and 150 back and forth, the fixed gear unit 200, the rotary gear unit 500, and the link member 600 may be collectively referred to as a 'rotation driving unit.'

Thus, the auxiliary arms 140 and 150 rotate back and forth by the link member 600, and the auxiliary arm connection members 160 rotatably support the auxiliary arms 140 and 150.

Figure 13:
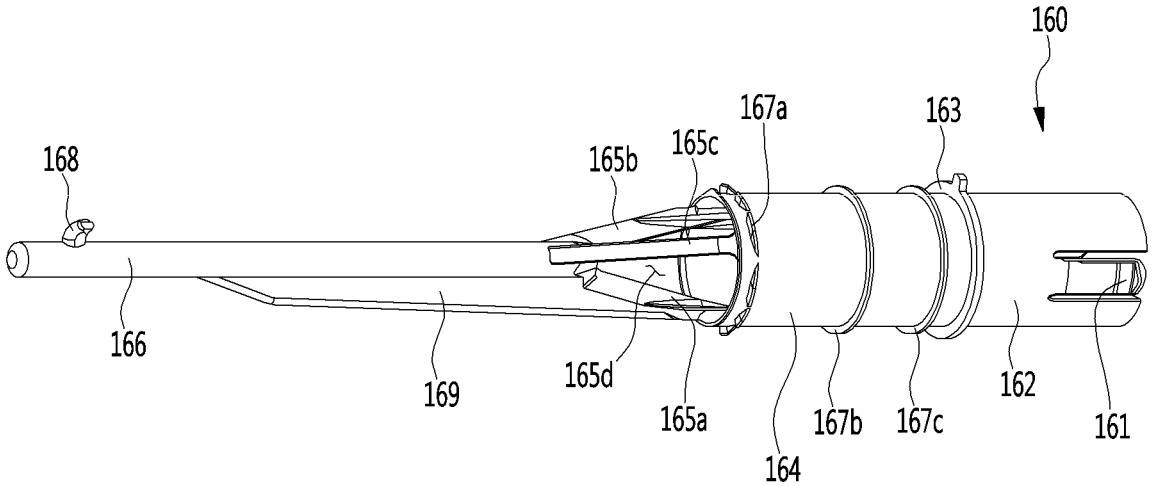
FIG. 13 is a perspective view of an example of an auxiliary arm connection member.
Figure 14:
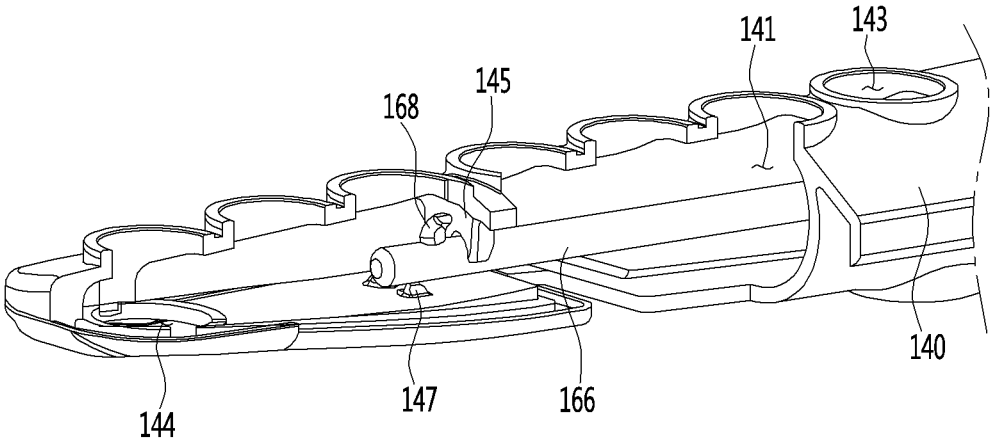
FIG. 14 is a perspective view of an example of a cutaway cross-section of a front end portion of an auxiliary arm.
Figure 15:
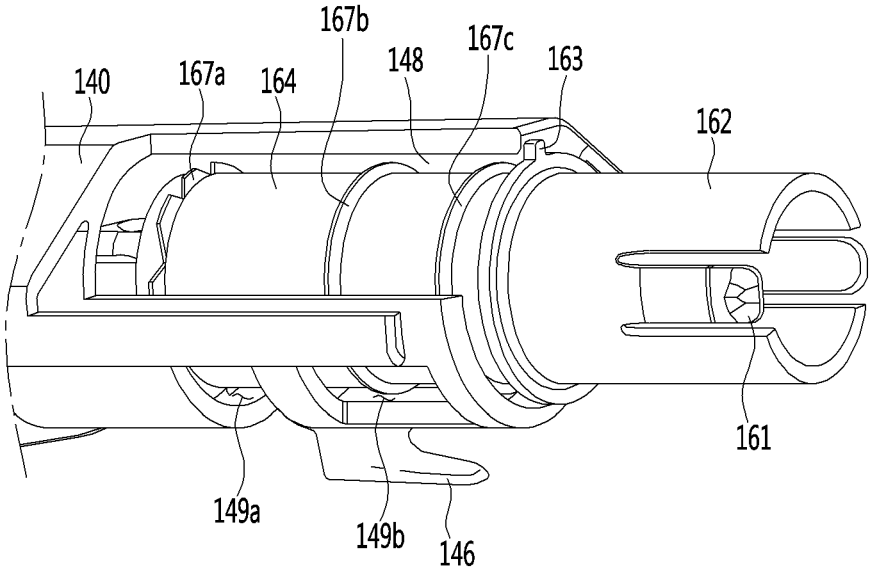
FIG. 15 is a perspective view of an example of a cutaway cross-section of a rear end portion of the auxiliary arm.

Referring to FIGS. 13 to 15, the auxiliary arm connection member 160 may include an insertion tube 162 inserted into the main arm 110, an extension tube 164 communicating with the insertion tube 162 to have the wash water introduced from the insertion tube 162 flow therethrough, a shaft 166 connected to the extension tube 164, a protrusion 168 protruding from the shaft 166, and a plurality of support ribs 165*a*, 165*b*, and 165*c* each having one end portion connected to the extension tube 164 and the other end portion connected to the shaft 166. Meanwhile, the insertion tube 162 and the extension tube 164 may be collectively referred to as a flow tube.

The shaft 166 may be inserted into the first auxiliary flow passage 141 formed in the first auxiliary arm 140. The wash water provided from the main arm 110 flows through the first auxiliary flow passage 141, and the wash water flowing through the first auxiliary flow passage 141 is sprayed to the outside through the auxiliary spray holes 143 and 144.

The protrusion 168 may be formed in a hook shape as illustrated. A departure prevention part 145 configured to contact the protrusion 168 may be disposed at an inner circumferential surface of the first auxiliary flow passage 141.

The departure prevention part 145 may protrude downward from an upper surface portion of the first auxiliary flow passage 141. Also, the departure prevention part 145 may be formed to surround at least a portion of the shaft. Accordingly, the first auxiliary arm 140 is prevented from departing from the auxiliary arm connection member 160 even when the first auxiliary arm 140 rotates within a predetermined range while being fastened to the auxiliary arm connection member 160.

The first auxiliary arm 140 may further include a support part 147 protruding upward from a floor surface of the first auxiliary flow passage 141. The support part 147 may be formed to surround at least a portion of the shaft 166.

That is, the departure prevention part 145 may be formed in a shape surrounding the shaft 166 from the top, and the support part 147 may be formed in a shape surrounding the shaft 166 from the bottom. Accordingly, the departure prevention part 145 and the support part 147 may serve to facilitate a relative rotation between the shaft 166 and the first auxiliary arm 140.

In addition, a load of the first auxiliary arm 140 may be applied to the shaft 166 due to the departure prevention part 145 coming in contact with the shaft 166.

The insertion tube 162 may be inserted into the first outlet 111*a*. Accordingly, the insertion tube 162 communicates with a transfer flow passage, and the wash water is introduced into the insertion tube 162 from the main arm 110. Also, a flow prevention part 161 to press inner circumferential surfaces of the transfer flow passages may be disposed at the insertion tube 162.

The flow prevention part 161 may protrude from a surface of the insertion tube 162. Also, the flow prevention part 161 may be formed in a shape that is inclined outward after a portion of the insertion tube 162 is cut out.

A limiting part 163 disposed between an end portion of the first auxiliary arm 140 and an end portion of the first extension part 111 may be formed on an outer circumferential surface of the insertion tube 162. The limiting part 163 may serve to limit an insertion range of the insertion tube 162. Accordingly, the auxiliary arm connection member 160 may be fixed to the main arm 110.

A plurality of bearings 167*a*, 167*b*, and 167*c* may protrude from an outer circumferential surface of the extension tube 164. The plurality of bearings 167*a*, 167*b*, and 167*c* may come in contact with the inner circumferential surface of the first auxiliary arm 140.

The first auxiliary arm 140 may further include a contact part 148 disposed at the inner circumferential surface of the first auxiliary flow passage 141 to come in contact with the plurality of bearings 167*a*, 167*b*, and 167*c*. When the first auxiliary arm 140 rotates, the plurality of bearings 167*a*, 167*b*, and 167*c* and the contact part 148 may be rubbed against each other.

Discharge holes 149*a* and 149*b* communicating with an outer portion of the first auxiliary arm 140 may be formed in the contact part 148. The wash water that has flowed backward from the first auxiliary flow passage 141 toward the contact part 148 may be discharged to the outer portion of the first auxiliary arm 140 via the discharge holes 149*a* and 149*b*. The discharge holes 149*a* and 149*b* may include a first discharge hole 149*a* formed in front of the first power transfer unit 146, and a second discharge hole 149*b* formed at the rear of the first power transfer unit 146.

The plurality of bearings 167*a*, 167*b*, and 167*c* may include a first bearing 167*a* formed of a plurality of protruding portions, and a second bearing 167*b* and a third bearing 167*c* formed of a ring-shaped rib along the outer circumferential surface of the extension tube 164.

The load of the first auxiliary arm 140 may be supported by the auxiliary arm connection member 160 due to the first auxiliary arm 140 coming in contact with the auxiliary arm connection member 160 at areas of the contact part 148 and the departure prevention part 145. Accordingly, the sagging of the first auxiliary arm 140 may be prevented.

The plurality of support ribs 165*a*, 165*b*, and 165*c* may serve to support the shaft 166. Each of the support ribs 165*a*, 165*b*, and 165*c* may be disposed to be equiangular from each other with respect to the shaft 166.

The plurality of support ribs 165*a*, 165*b*, and 165*c* may include a first support rib 165*a* disposed below the shaft 166, and a second support rib 165*b* and a third support rib 165*c* disposed above the shaft 166.

A flow hole through which the wash water may flow may be formed between the support ribs 165*a*, 165*b*, and 165*c*. Specifically, a flow hole 165*d* may be formed between the first support rib 165*a* and the third support rib 165*c*. A flow hole may also be formed between the first support rib 165*a* and the second support rib 165*b* and between the second support rib 165*b* and the third support rib 165*c*.

The wash water introduced into the insertion tube 162 may be discharged through the flow hole 165*d* via the extension tube 164. The wash water discharged through the flow hole 165*d* may flow to the first auxiliary flow passage 141 and may be sprayed through the auxiliary spray holes 143 and 144.

The auxiliary arm connection member 160 may further include a reinforcement rib 169 to reinforce the strength of the shaft 166. The reinforcement rib 169 may extend downward from a lower portion of the shaft 166. Also, the reinforcement rib 169 may be connected to the first support rib 165*a*.

In some examples the insertion tube 162 may be integrally formed with the main arm 110. The insertion tube 162 and the extension tube 164 may also be integrally formed with the main arm 110. The insertion tube 162 and the extension tube 164 may form portions of the transfer flow passages.

Figure 16A:
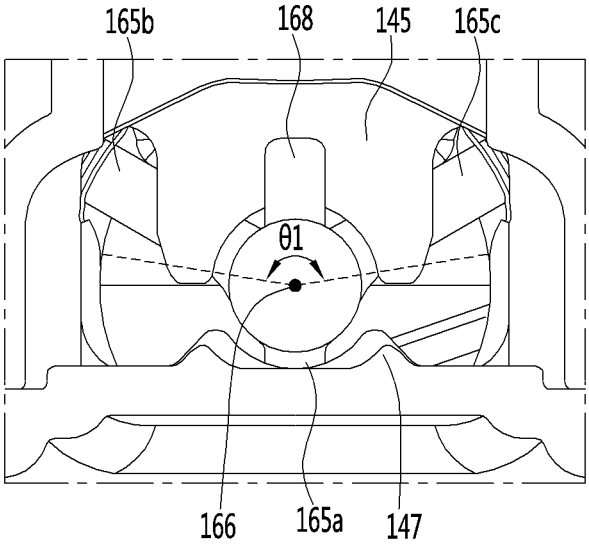
FIG. 16 (*a*) to FIG. 16 (*b*) are views illustrating a state in which the auxiliary arm rotates while being coupled to the auxiliary arm connection member.
Figure 16B:
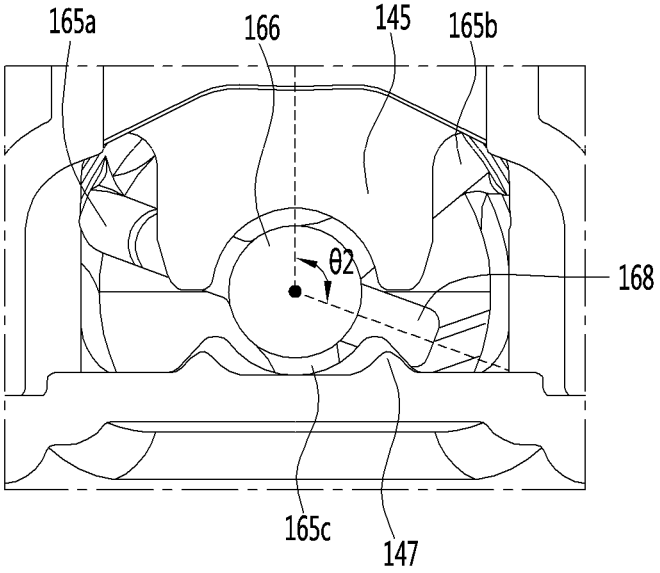

Referring to (a) of FIG. 16, the first auxiliary arm 140 may be rotatable within a range in which the protrusion 168 and the departure prevention part 145 come in contact. The first auxiliary arm 140 may be rotatable within an angle range θ1 occupied by the departure prevention part 145. The support part 147 may support the shaft 166.

Referring to (b) of FIG. 16, the first auxiliary arm 140 may depart from the auxiliary arm connection member 160 when the first auxiliary arm 140 has rotated counterclockwise by a predetermined angle θ2. In other words, when the first auxiliary arm 140 rotates by the predetermined angle θ2, the coupling between the first auxiliary arm 140 and the auxiliary arm connection member 160 may be released.

When required by the user, the first auxiliary arm 140 may be removed from the auxiliary arm connection member 160 by rotating the first auxiliary arm 140 by the predetermined angle θ2. The first auxiliary arm 140 may be rotatably mounted on the main arm 110 and easily removed at the same time due to the auxiliary arm connection member 160 disposed at the spray arm 100.

The maximum rotational angle θ2 of the first auxiliary arm 140 may be set approximately as 110° in the drawings. The maximum rotational angle θ2 should be designed to be greater than the rotational range of the first auxiliary arm 140 due to the reciprocating movements of the link member 600.

Figure 17:
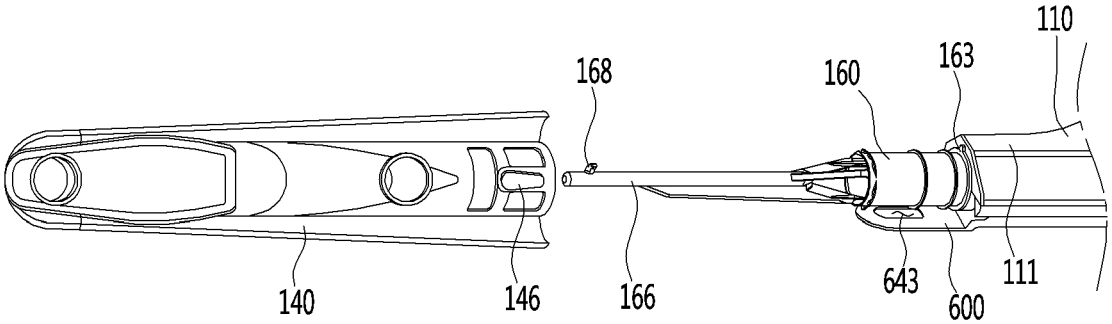
FIGS. 17 to 19 are views sequentially illustrating states in which the auxiliary arm is being coupled to the auxiliary arm connection member.
Figure 18:
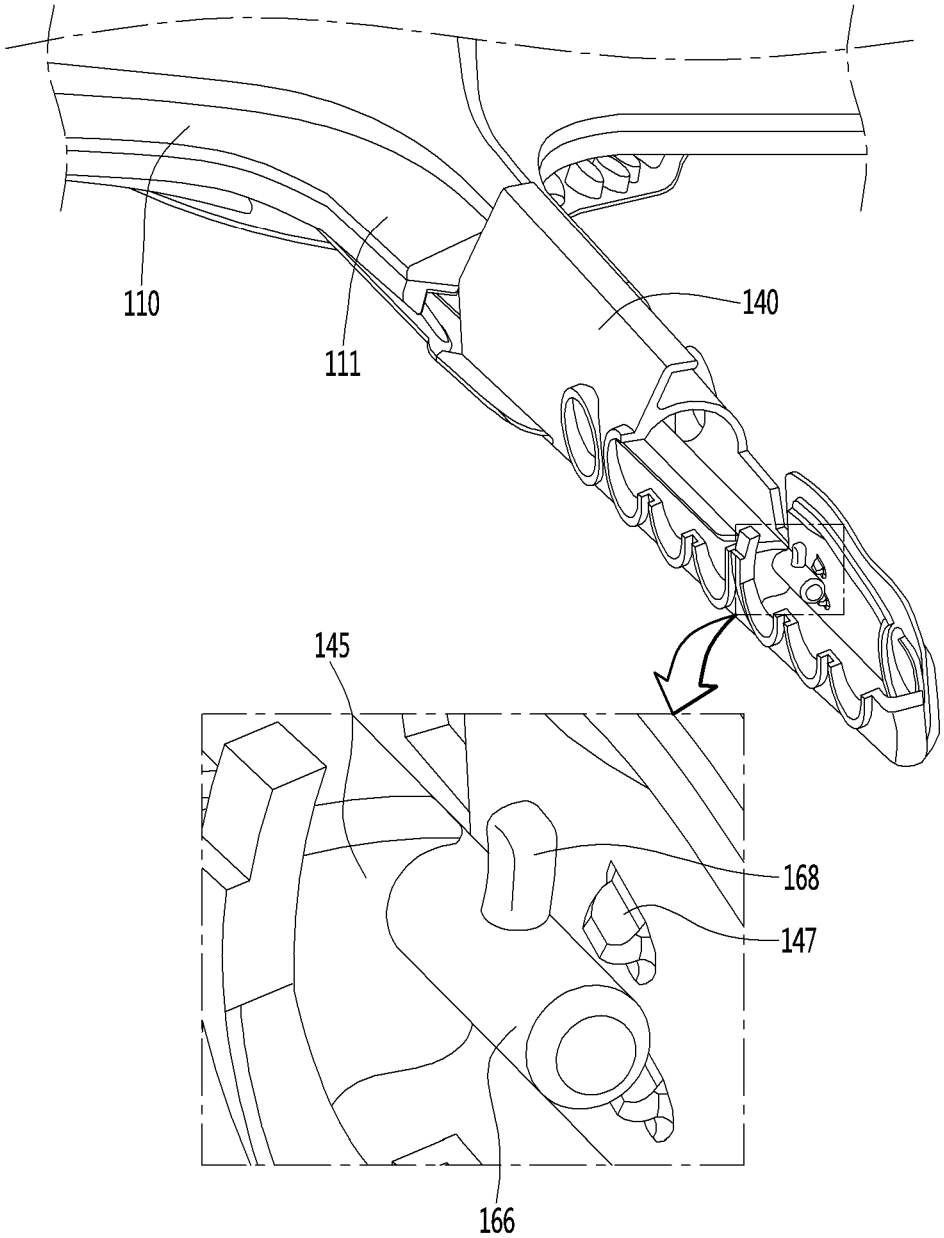
Figure 19:
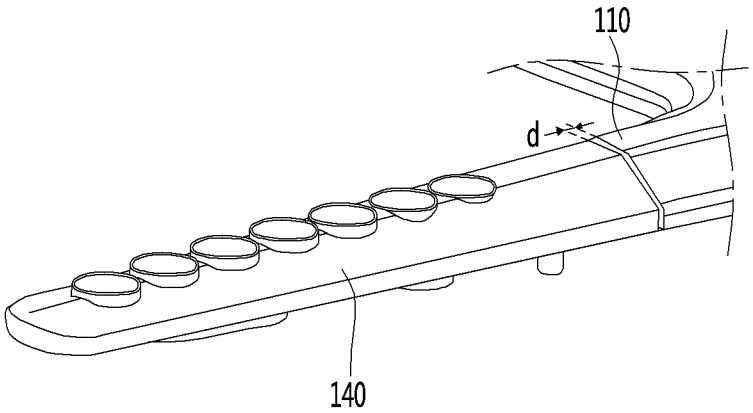

Referring to FIGS. 17 to 19, the auxiliary arm connection member 160 may be first inserted into the main arm 110 (refer to FIG. 17). The insertion range of the auxiliary arm connection member 160 may be limited due to the limiting part 163 being locked to an end portion of the first extension part 111.

The first auxiliary arm 140 may be inserted into the auxiliary arm connection member 160 while being obliquely rotated. Specifically, the first auxiliary arm 140 may be inserted into the auxiliary arm connection member 160 while the protrusion 168 is rotated by an angle in a range of non-contact with the departure prevention part 145 and the support part 147 (refer to FIG. 18).

The first auxiliary arm 140 may be rotated to a home position (refer to FIG. 19).

The first power transfer unit 146 disposed at the first auxiliary arm 140 may be inserted into the first locking part 643. Since the first auxiliary arm 140 rotates only within a movement range of the link member 600, the first auxiliary arm 140 does depart from the auxiliary arm connection member 160 as long as the user does not release the coupling between the first auxiliary arm 140 and the link member 600.

The first extension part 111 and the first auxiliary arm 140 may be spaced apart by a predetermined distance d. Accordingly, when the first auxiliary arm 140 rotates, friction with the main arm 110 may be reduced.

Figure 20:
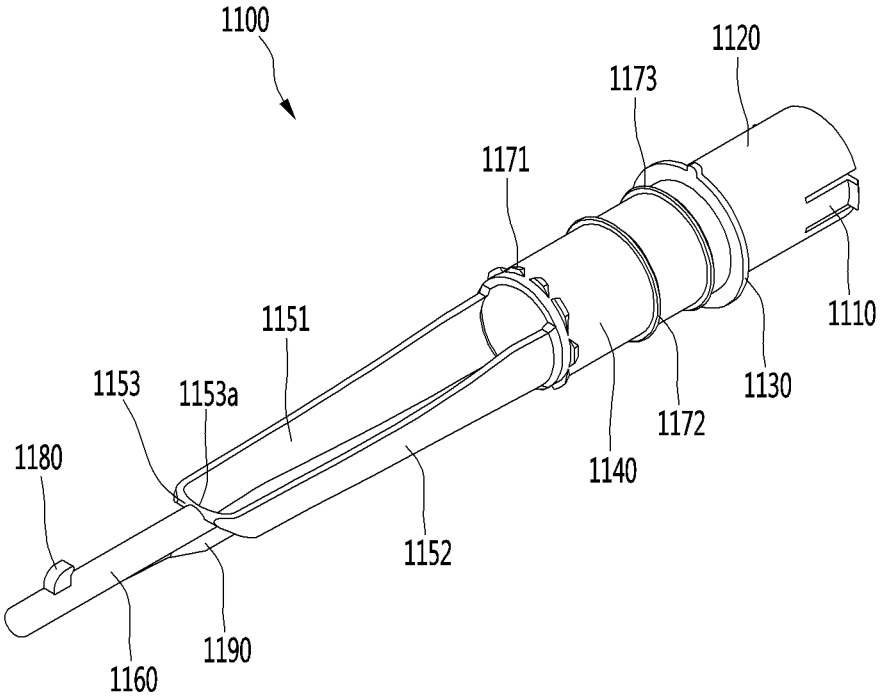
FIG. 20 is a perspective view of an example of an auxiliary arm connection member.
Figure 21:
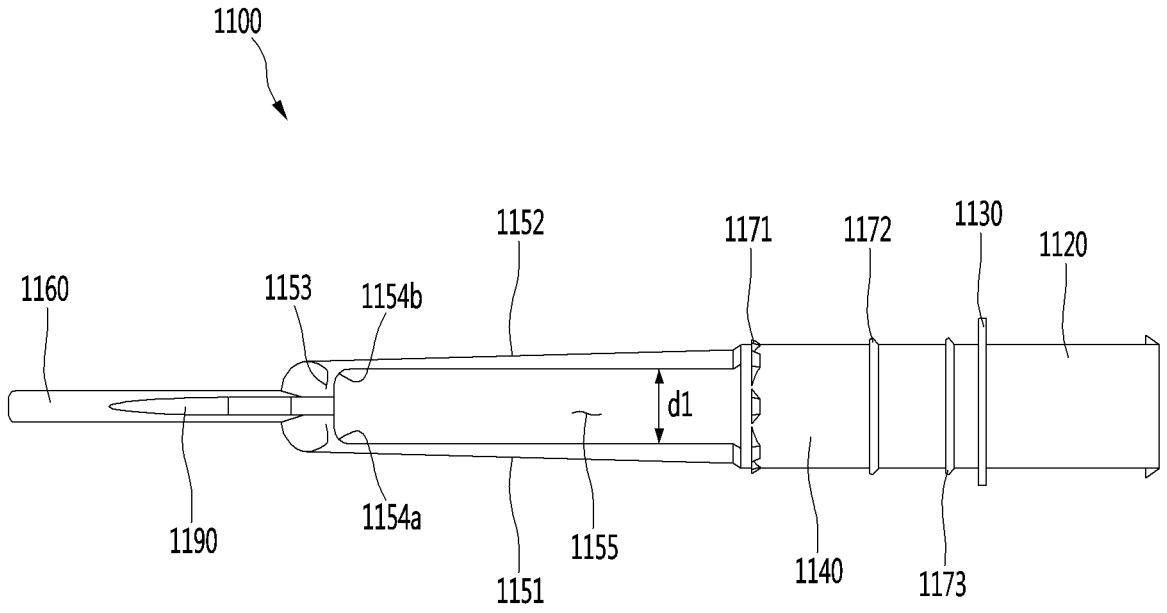
FIG. 21 is a bottom view of the auxiliary arm connection member of FIG. 20.
Figure 22:
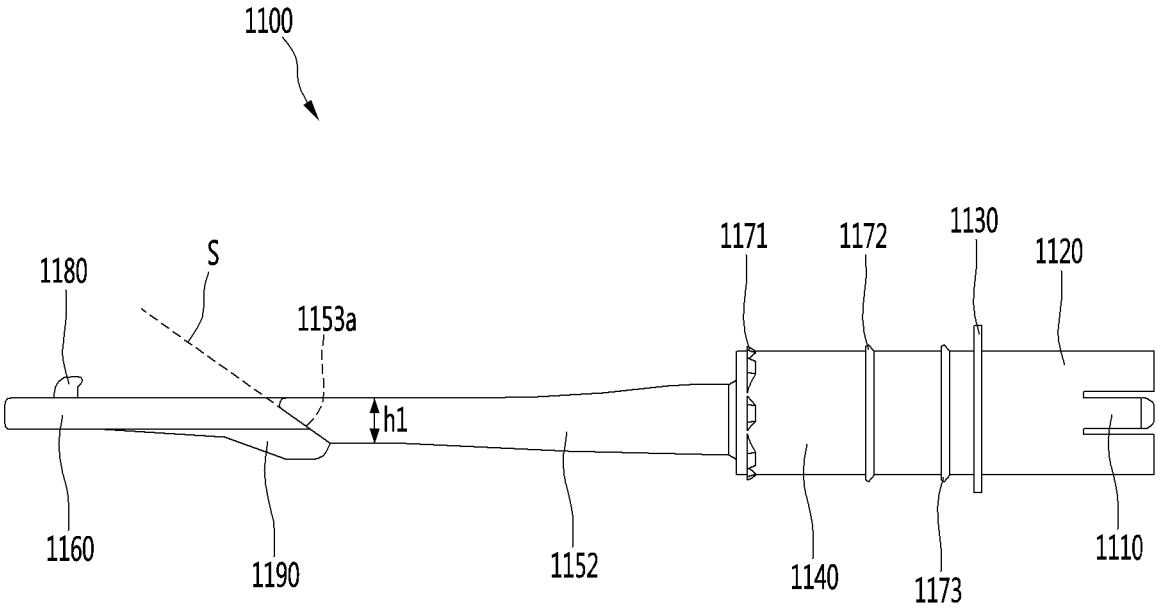
FIG. 22 is a side view of the auxiliary arm connection member of FIG. 20.

Referring to FIGS. 20 to 22, an auxiliary arm connection member 1100 may include an insertion tube 1120 inserted into the main arm 110, an extension tube 1140 configured to communicate with the insertion tube 1120 to have wash water introduced from the insertion tube 1120, a pair of support ribs 1151 and 1152 extending from the extension tube 1140, a third support rib 1153 connected to the pair of support ribs 1151 and 1152, a shaft 1160 extending from the third support rib 1153, and a protrusion 1180 protruding from the shaft 1160. The insertion tube 1120 and the extension tube 1140 may be collectively referred to as a flow tube.

The pair of support ribs 1151 and 1152 may include a first support rib 1151 disposed at one side of the extension tube 1140, and a second support rib 1152 disposed at the other side of the extension tube 1140.

The wash water introduced through the insertion tube 1120 and the extension tube 1140 may be introduced into the first auxiliary flow passage 141 through a vertical flow hole 1155 disposed between the first support rib 1151 and the second support rib 1152.

The first support rib 1151 and the second support rib 1152 may be disposed to face each other. The first support rib 1151 and the second support rib 1152 may be spaced apart by a predetermined distance d1.

The auxiliary arm connection member 1100 may be designed such that the distance d1 between the first support rib 1151 and the second support rib 1152 is similar to an inner diameter of the extension tube 1140 or the insertion tube 1120.

The first support rib 1151 and the second support rib 1152 may be disposed to be maximally spaced apart from each other within a range of non-contact with the inner circumferential surface of the first auxiliary flow passage 141.

A connection part 1154*a* between the first support rib 1151 and the third support rib 1153 and a connection part 1154*b* between the second support rib 1152 and the third support rib 1153 may be rounded. An effect of preventing the foreign substances from being caught may be further improved.

An inner circumferential surface 1153*a* of the third support rib 1153 may be inclined to form an acute angle with the shaft 1160. Accordingly, the wash water introduced through the insertion tube 1120 and the extension tube 1140 may be guided upward by the third support rib 1153.

The wash water introduced through the flow tube may be guided to be sprayed through the first upper auxiliary spray hole 143. Accordingly, a spraying force of the first upper auxiliary spray hole 143 may be reinforced.

In addition, the first support rib 1151, the second support rib 1152, and the third support rib 1153 may have a predetermined height h1. Accordingly, an efficiency of guiding the wash water by the inner circumferential surface 1153*a* of the third support rib 1153 may increase. That is, most of the wash water introduced through the insertion tube 1120 and the extension tube 1140 may be guided upward by the inner circumferential surface 1153*a* of the third support rib 1153.

Figure 23:
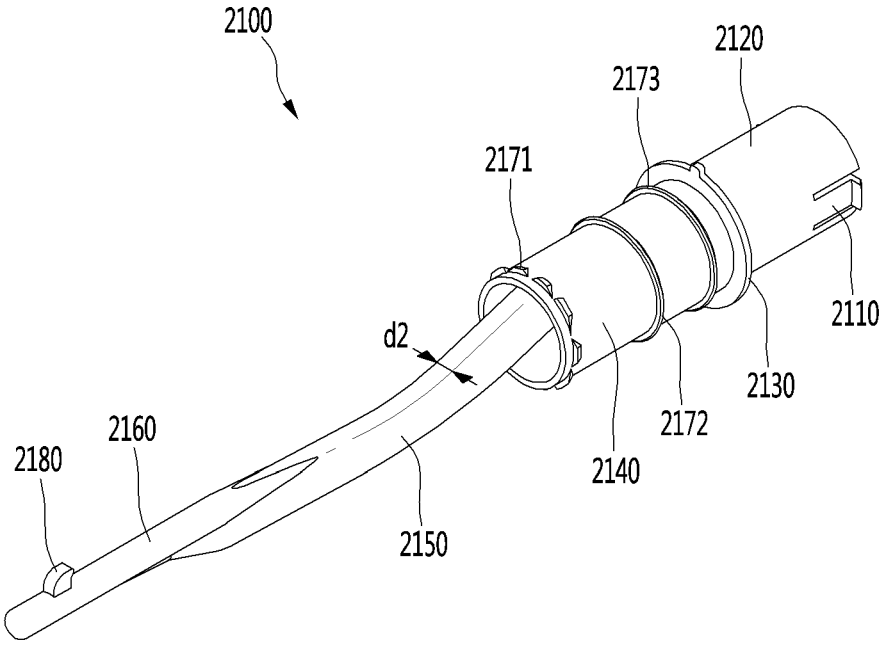
FIG. 23 is a perspective view of an example of an auxiliary arm connection member.
Figure 24:
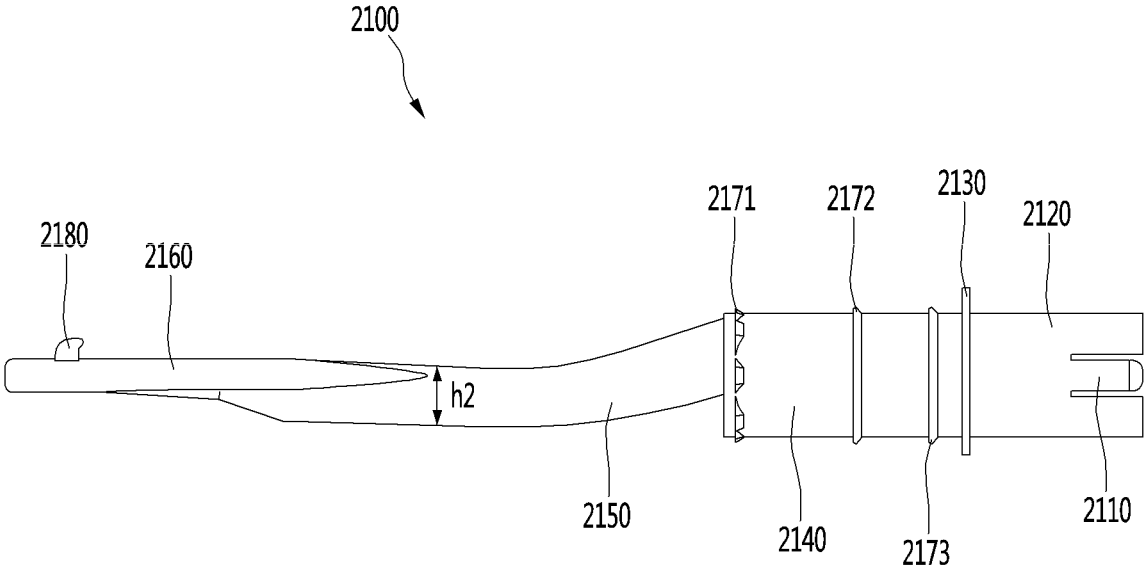
FIG. 24 is a side view of the auxiliary arm connection member of FIG. 23.
Figure 25:
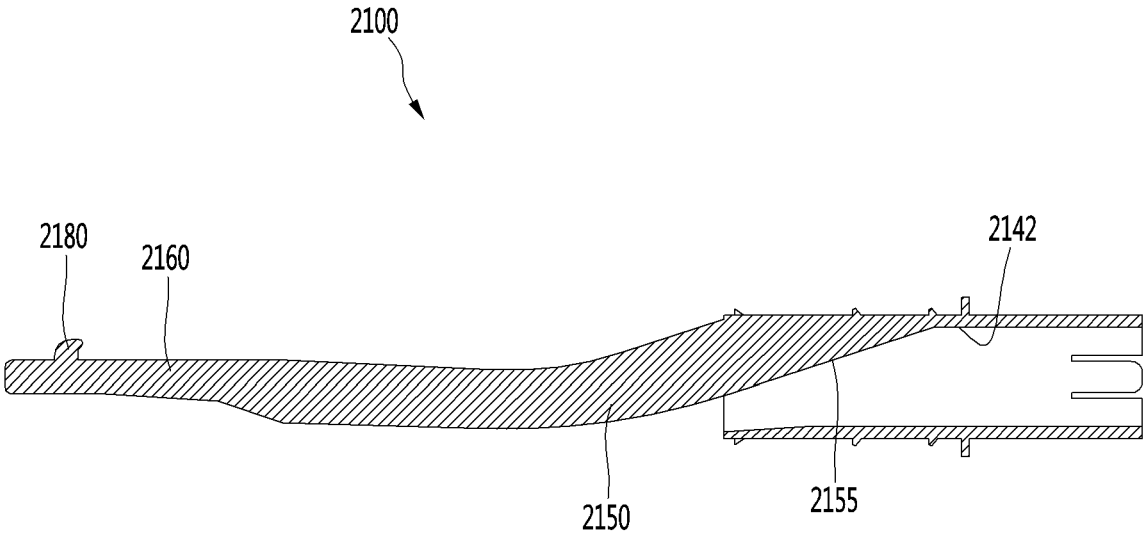
FIG. 25 is a side cross-sectional view of the auxiliary arm connection member of FIG. 23.

Referring to FIGS. 23 to 25, an auxiliary arm connection member 2100 may include an insertion tube 2120 inserted into the main arm 110, an extension tube 2140 configured to communicate with the insertion tube 2120 to have wash water introduced from the insertion tube 2120 flow, a support rib 2150 configured to extend from the extension tube 2140, a shaft 2160 configured to extend from the support rib 2150, and a protrusion 2180 protruding from the shaft 2160. The insertion tube 2120 and the extension tube 2140 may be collectively referred to as a flow tube.

The auxiliary arm connection member 2100 may have only one support rib 2150. The support rib 2150 may extend from an inner circumferential surface 2142 of the flow tube. Specifically, the support rib 2150 may be connected to an upper portion of the inner circumferential surface 2142 of the flow tube.

The support rib 2150 may be disposed not only at a rear end portion of the shaft 2160 but also at a lower end portion of the shaft 2160. Accordingly, the support rib 2150 may serve as a reinforcement rib that reinforces the strength of the shaft 2160.

A vertical width h2 of the support rib 2150 may be formed greater than a horizontal width d2 thereof. Accordingly, vertical warping of the support rib 2150 may be prevented.

A rear end portion 2155 of the support rib 2150 may be inclined by a predetermined angle. Accordingly, flowing of the wash water introduced through the insertion tube 2120 and the extension tube 2140 may be facilitated.

The shaft 2160 and the support rib 2150 may be integrally formed.

Figure 26:
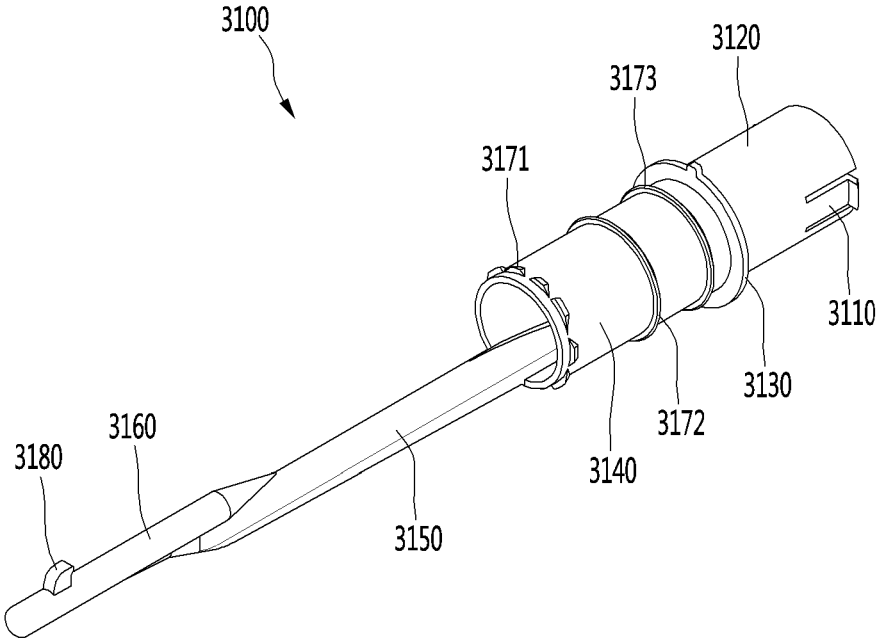
FIG. 26 is a perspective view of an example of an auxiliary arm connection member.
Figure 27:
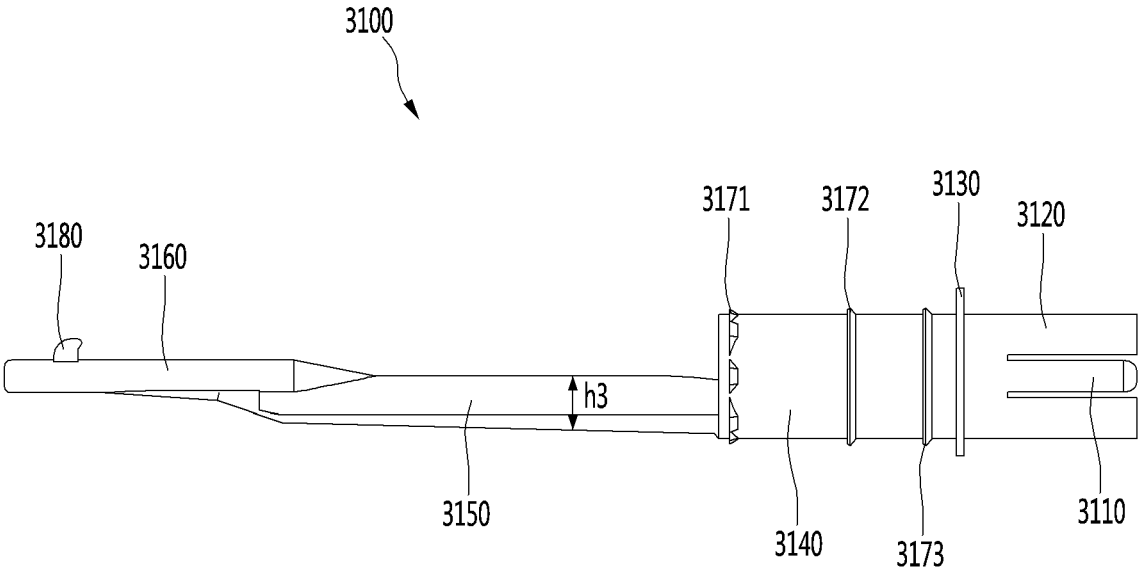
FIG. 27 is a side view of the auxiliary arm connection member of FIG. 26.
Figure 28:
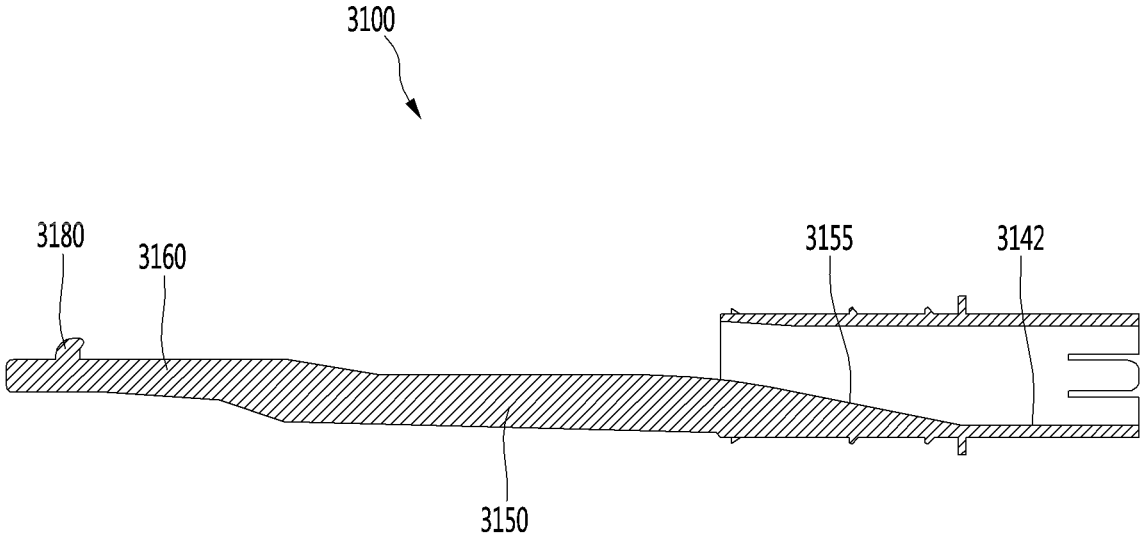
FIG. 28 is a side cross-sectional view of the auxiliary arm connection member of FIG. 26.

Referring to FIGS. 26 to 28, an auxiliary arm connection member 3100 may include an insertion tube 3120 inserted into the main arm 110, an extension tube 3140 configured to communicate with the insertion tube 3120 to have wash water introduced from the insertion tube 3120 flow, a support rib 3150 configured to extend from the extension tube 3140, a shaft 3160 configured to extend from the support rib 3150, and a protrusion 3180 configured to extend from the shaft 3160.

In some examples the support rib 3150 may be connected to a lower portion of the inner circumferential surface 3142 of the flow tube.

The support rib 3150 may be disposed at a lower end portion of the shaft 3160. Accordingly, the support rib 3150 may serve as a reinforcement rib that reinforces the strength of the shaft 3160.

A vertical width h3 of the support rib 3150 may be formed greater than a horizontal width, and the vertical warping of the support rib 3150 may be prevented.

A rear end portion 3155 of the support rib 3150 may be inclined by a predetermined angle and the flow of the wash water introduced through the insertion tube 3120 and the extension tube 3140 may be facilitated.

Although implementations have been described with reference to a number of illustrative examples thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a sump configured to store water;

a main arm that is disposed at the sump and that is configured to supply water from the sump;

an auxiliary arm that is rotatably disposed at the main arm and that is configured to spray water; and an auxiliary arm connection member disposed at the main arm and that is configured to rotatably support the auxiliary arm, wherein the auxiliary arm includes an auxiliary flow passage that is configured to allow water to flow through the auxiliary arm, wherein the main arm includes a transfer flow passage that is in fluid communication with the auxiliary flow passage, wherein the auxiliary arm connection member comprises:

a flow tube that is disposed at the main arm and that is in fluid communication with the transfer flow passage and the auxiliary flow passage, a support rib that is configured to extend from an inner circumferential surface of the flow tube, a shaft that is configured to extend from a front end portions of the support rib, and a protrusion that is configured to extend from the shaft, and a departure restriction part that is disposed at the auxiliary arm and that is configured to make contact with the protrusion to prevent the departure of the auxiliary arm.

2. The dishwasher according to claim 1, wherein a rear end portion of the support rib is configured to extend to an upper portion of the inner circumferential surface of the flow tube.

3. The dishwasher according to claim 2, wherein the rear end portion of the support rib is configured to extend downward from the upper portion of the inner circumferential surface of the flow tube.

4. The dishwasher according to claim 2, wherein the rear end portion of the support rib is configured to be inclined at an acute angle with the upper portion of the inner circumferential surface of the flow tube.

5. The dishwasher according to claim 2, wherein a vertical width of the support rib is configured to be greater than a horizontal width of the support rib.

6. The dishwasher according to claim 1, wherein a rear end portion of the support rib is configured to extend to a lower portion of the inner circumferential surface of the flow tube.

7. The dishwasher according to claim 6, wherein the rear end portion of the support rib is configured to extend upward from the lower portion of the inner circumferential surface of the flow tube.

8. The dishwasher according to claim 6, wherein the rear end portion of the support rib is configured to be inclined at an acute angle with the lower portion of the inner circumferential surface of the flow tube.

9. The dishwasher according to claim 6, wherein a vertical width of the support rib is configured to be greater than a horizontal width of the support rib.

10. The dishwasher according to claim 1, wherein the shaft and the support rib are configured to be integral with the flow tube.

11. The dishwasher according to claim 1, wherein the front end portion of the support rib and a rear end portion of the shaft are configured to overlap for a predetermined length.

12. The dishwasher according to claim 1, wherein the front end portion of the support rib is configured to extend to a lower portion of the shaft.

13. The dishwasher according to claim 1, wherein water flowing through the transfer flow passage is introduced into the auxiliary flow passage via the flow tube.

14. The dishwasher according to claim 1, wherein the departure restriction part is configured to surround at least a portion of the shaft.

15. The dishwasher according to claim 1, further comprising a support part that is configured to support the shaft and that is disposed at the auxiliary flow passage, wherein the support part is configured to surround at least a portion of the shaft.

16. The dishwasher according to claim 1, wherein the auxiliary arm connection member is configured to release from coupling with the auxiliary arm when the auxiliary arm is rotated to a position that defines a predetermined angle with the auxiliary arm connection member.

17. The dishwasher according to claim 1, further comprising a limiting part that is disposed at an outer circumferential surface of the flow tube and that is configured to limit an insertion range of the flow tube.

18. The dishwasher according to claim 1, further comprising:

a bearing that is disposed at the outer circumferential surface of the flow tube; and a contact part that is disposed at the auxiliary arm and that is configured to make contact with the bearing unit.

19. The dishwasher according to claim 18, wherein the contact part includes a discharge hole that is configured to communicate with an outer portion of the auxiliary arm, wherein the discharge hole is configured to discharge water flowing backward from the auxiliary flow passage to the contact part.

20. The dishwasher according to claim 1, wherein the flow tube is configured to be integral with the main arm.

* * * * *